US011357306B2

(12) United States Patent
Han et al.

(10) Patent No.: US 11,357,306 B2
(45) Date of Patent: Jun. 14, 2022

(54) APPARATUS FOR MANUFACTURING COSMETIC USING INSTANTANEOUS EMULSIFICATION

(71) Applicant: Amorepacific Corporation, Seoul (KR)

(72) Inventors: Kyung Sup Han, Yongin-si (KR); Jin Nam, Yongin-si (KR); Won Seok Park, Yongin-si (KR)

(73) Assignee: Amorepacific Corporation, Seoul (KR)

( * ) Notice: Subject to any disclaimer, the term of this patent is extended or adjusted under 35 U.S.C. 154(b) by 0 days.

(21) Appl. No.: 16/729,728

(22) Filed: Dec. 30, 2019

(65) Prior Publication Data

US 2020/0205545 A1 Jul. 2, 2020

(30) Foreign Application Priority Data

Dec. 31, 2018 (KR) ..... 10-2018-0174274

(51) Int. Cl.
*A45D 34/00* (2006.01)
*B01F 3/08* (2006.01)
(Continued)

(52) U.S. Cl.
CPC ..... *A45D 34/00* (2013.01); *B01F 3/0807* (2013.01); *B01F 3/0861* (2013.01);
(Continued)

(58) Field of Classification Search
CPC .. B01F 3/0807; B01F 3/0865; B01F 13/0022; B01F 13/0059; B01F 13/002; B01F 3/0861; B05B 11/3084; A45D 34/00; A45D 2200/058; A45D 2200/052; A45D 2200/055
(Continued)

(56) References Cited

U.S. PATENT DOCUMENTS 4,546,922 A * 10/1985 Thometz ..... B05B 7/0408 137/625.4
4,773,562 A * 9/1988 Gueret ..... A45D 40/24 222/135
(Continued)

FOREIGN PATENT DOCUMENTS

KR 1020180108235 A 10/2018
WO 2018/174693 A2 9/2018

*Primary Examiner* — Charles P. Cheyney
(74) *Attorney, Agent, or Firm* — Sughrue Mion, PLLC

(57) ABSTRACT

The present invention relates to an apparatus for manufacturing cosmetic using instantaneous emulsification. Provided according to an aspect of the invention may be an apparatus for manufacturing cosmetic using instantaneous emulsification, which includes a housing which forms an outer appearance; an internal phase container which is replaceably coupled to the housing, and which stores internal phase fluid; an external phase container which is replaceably coupled to the housing, and which stores external phase fluid; a channel unit which generates emulsion by mixing the internal phase fluid provided from the internal phase container and the external phase fluid provided from the external phase container; and an operative unit which provides external force required to form and discharge emulsion at the channel unit by manipulation of a user.

13 Claims, 12 Drawing Sheets

(51) Int. Cl.
*B01F 13/00* (2006.01)
*B65D 83/00* (2006.01)
*B65D 83/68* (2006.01)

(52) U.S. Cl.
CPC ..... *B01F 13/0061* (2013.01); *B65D 83/0038* (2013.01); *B65D 83/685* (2013.01); *A45D 2034/005* (2013.01); *A45D 2200/052* (2013.01); *A45D 2200/055* (2013.01); *A45D 2200/058* (2013.01); *B01F 2003/083* (2013.01); *B01F 2003/0842* (2013.01); *B01F 2215/0031* (2013.01)

(58) Field of Classification Search
USPC ..... 222/135, 136, 145.8
See application file for complete search history.

(56) References Cited

U.S. PATENT DOCUMENTS

| | | | | |
|---|---|---|---|---|
| 5,169,029 | A * | 12/1992 | Behar | B05B 11/3084 128/200.23 |
| 9,655,431 | B2 * | 5/2017 | Ham | A45D 40/00 |
| 9,789,504 | B2 * | 10/2017 | Quennessen | B05B 11/3083 |
| 9,839,931 | B2 * | 12/2017 | Burrowes | B05B 11/3084 |
| 10,905,222 | B2 * | 2/2021 | Chen | A61K 8/31 |
| 2005/0005628 | A1 * | 1/2005 | Suh | A47J 36/02 62/371 |
| 2020/0002152 | A1 * | 1/2020 | Beyda | A47K 5/1201 |

* cited by examiner

【FIG. 1】
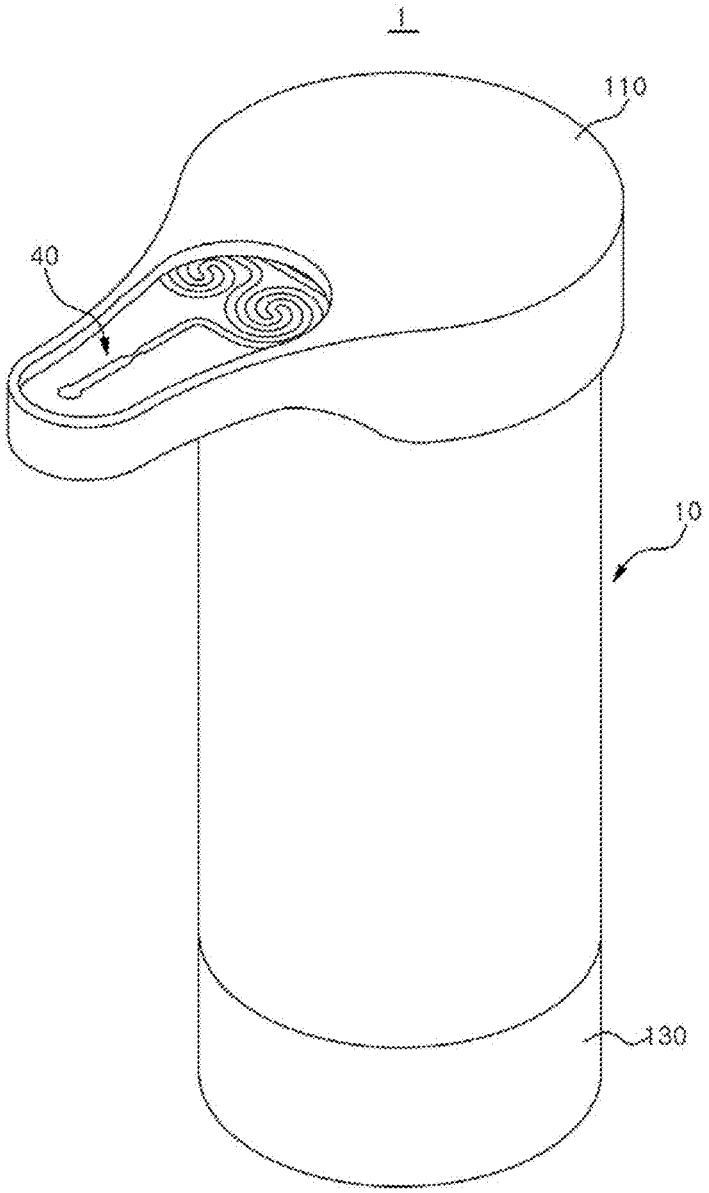

【FIG. 2】
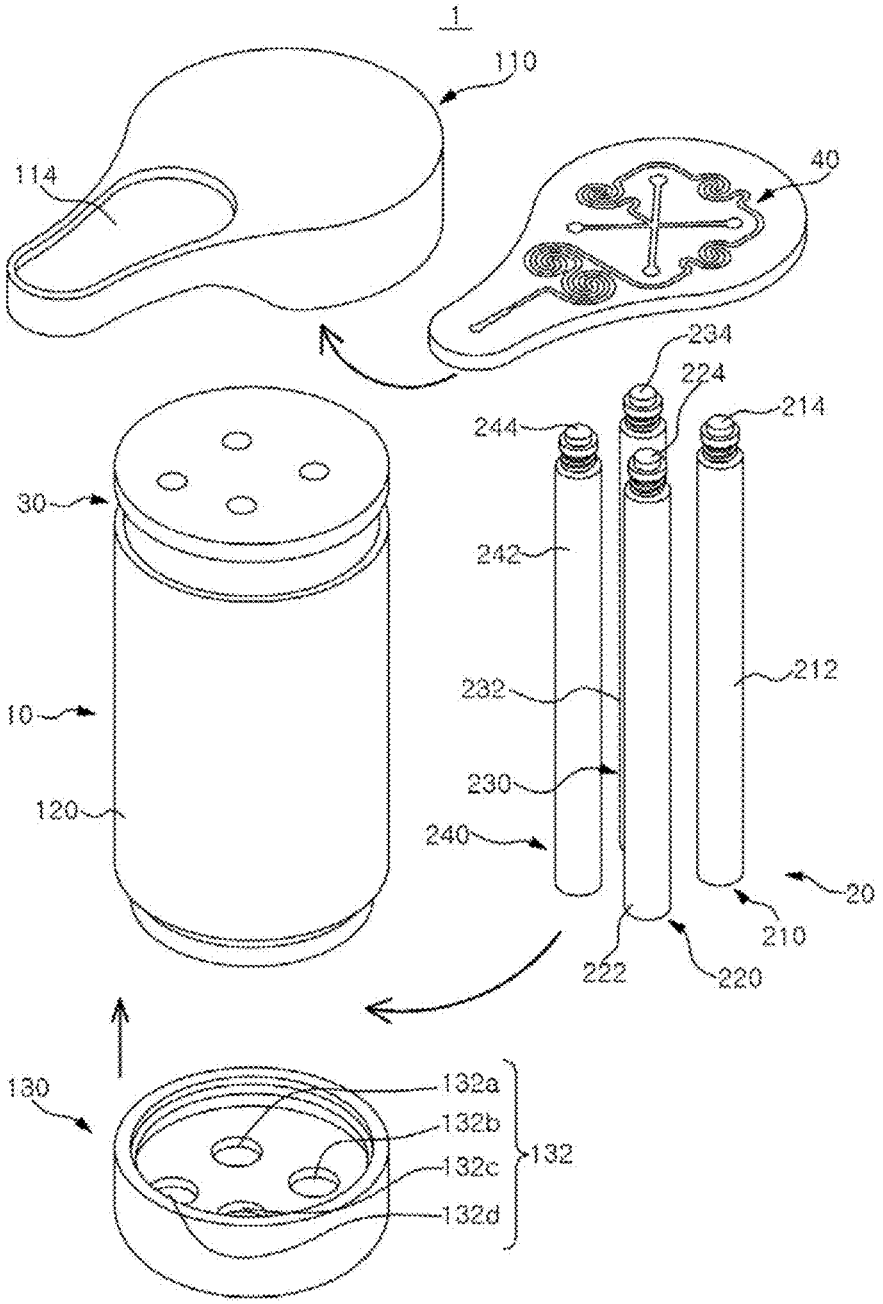

【FIG. 3】
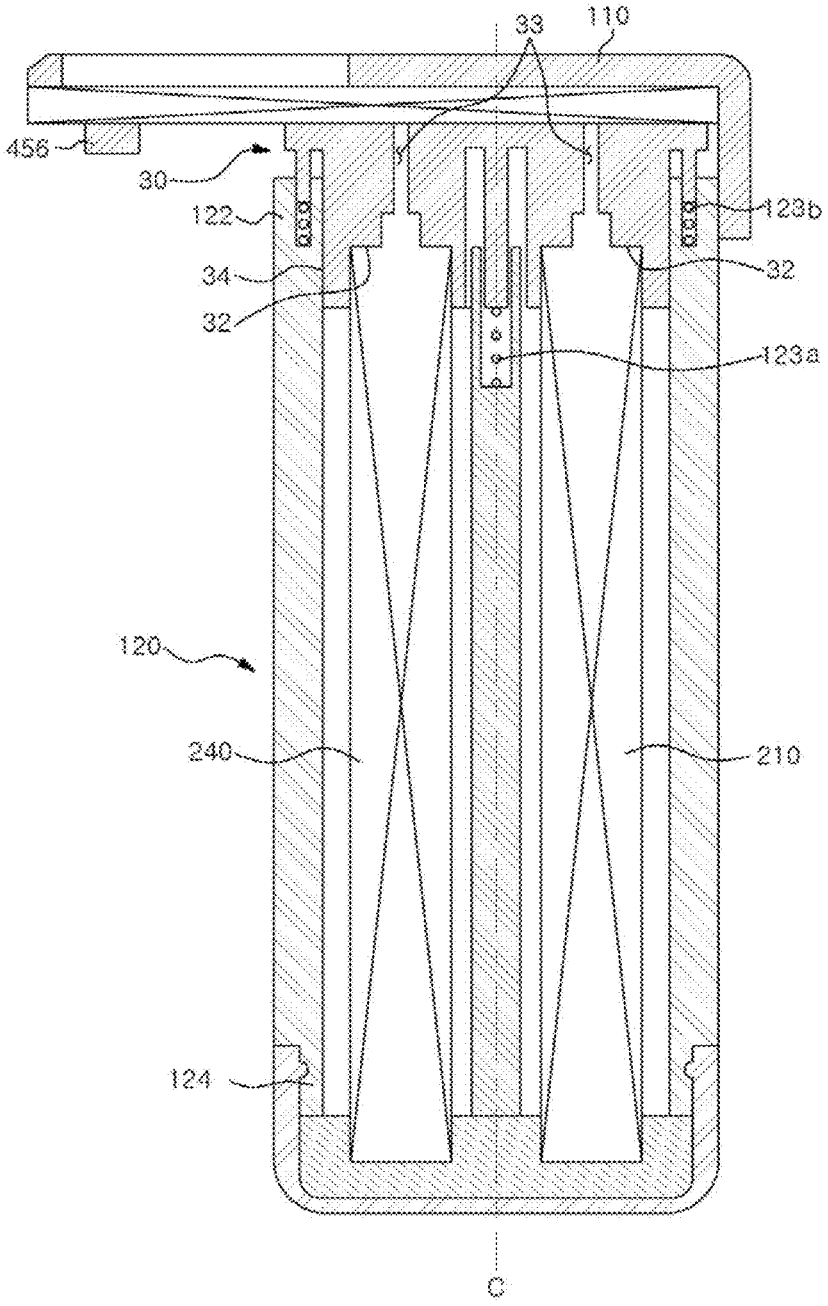

【FIG. 4】
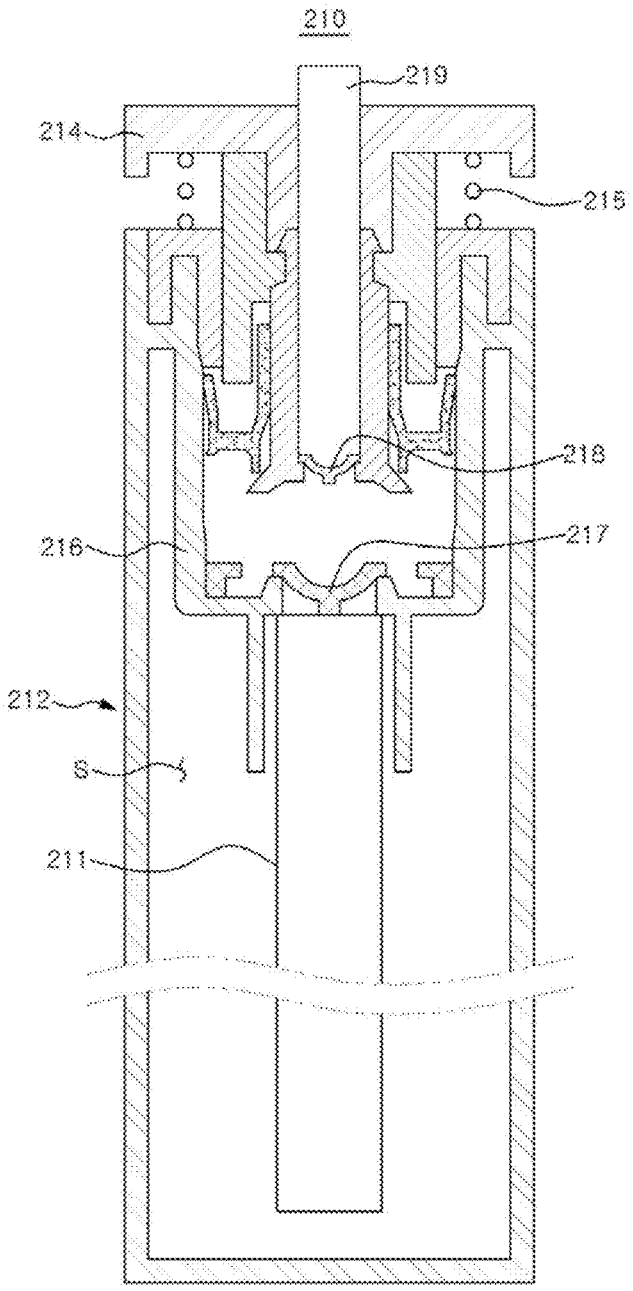

【FIG. 5】
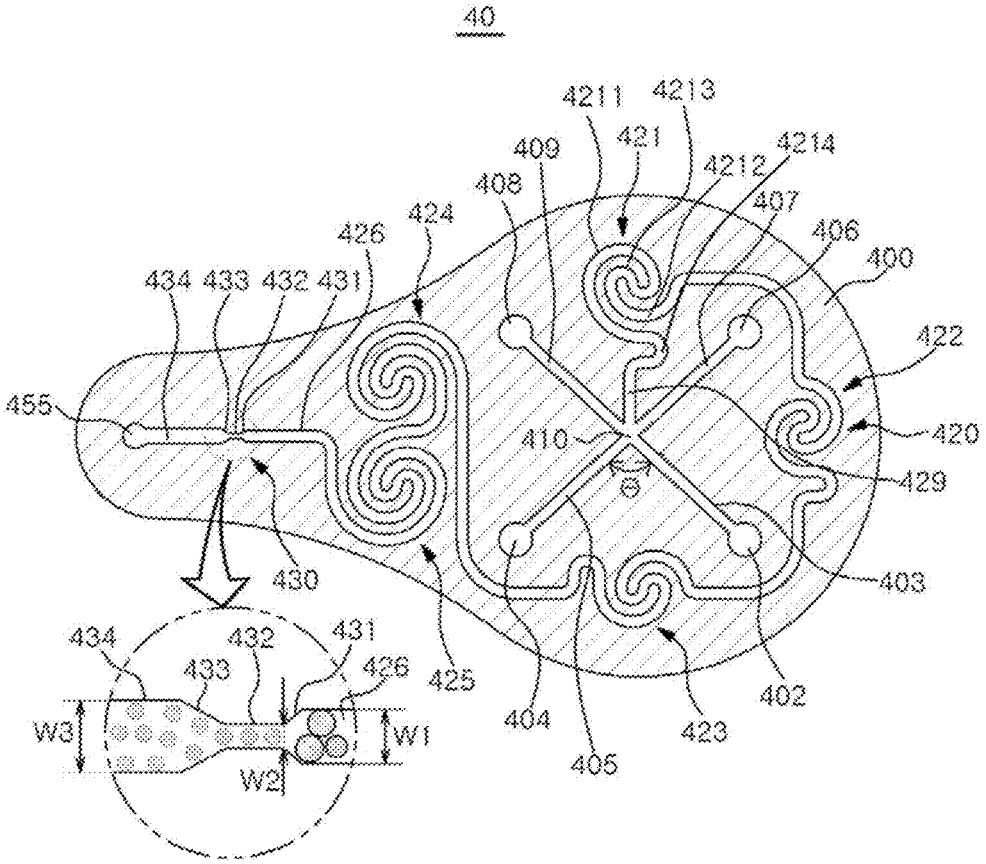

【FIG. 6】
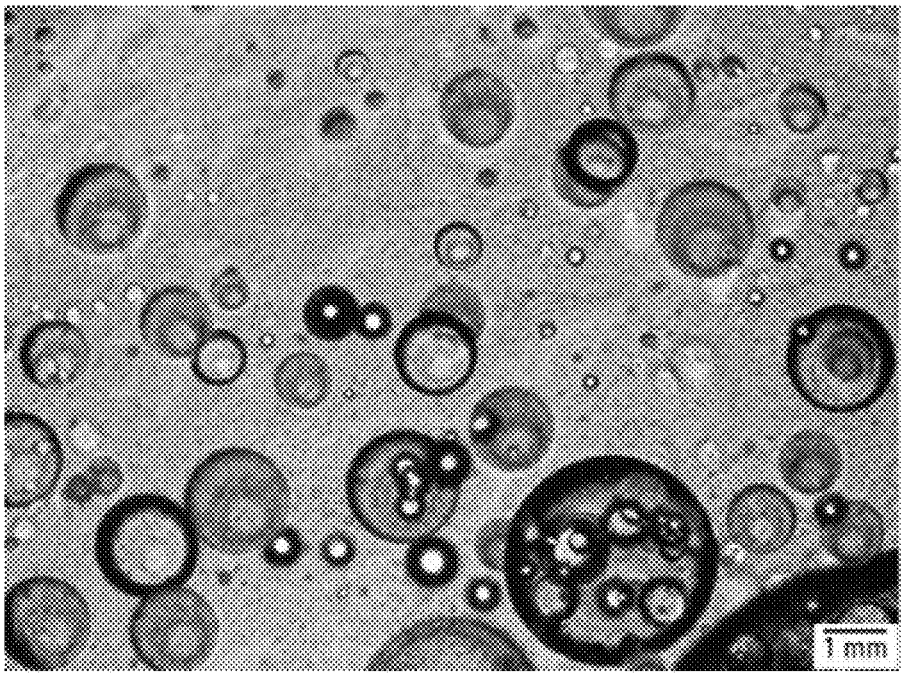

【FIG. 7】
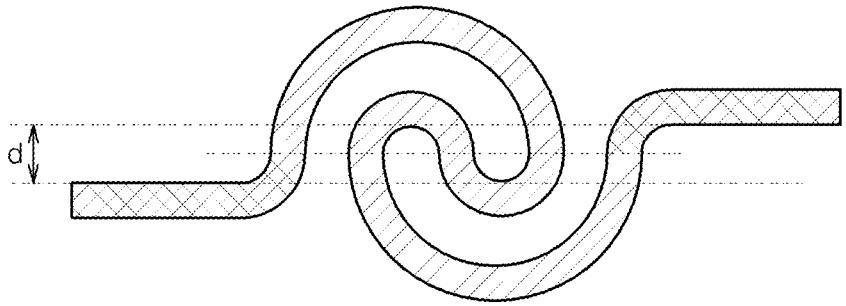

【FIG. 8】
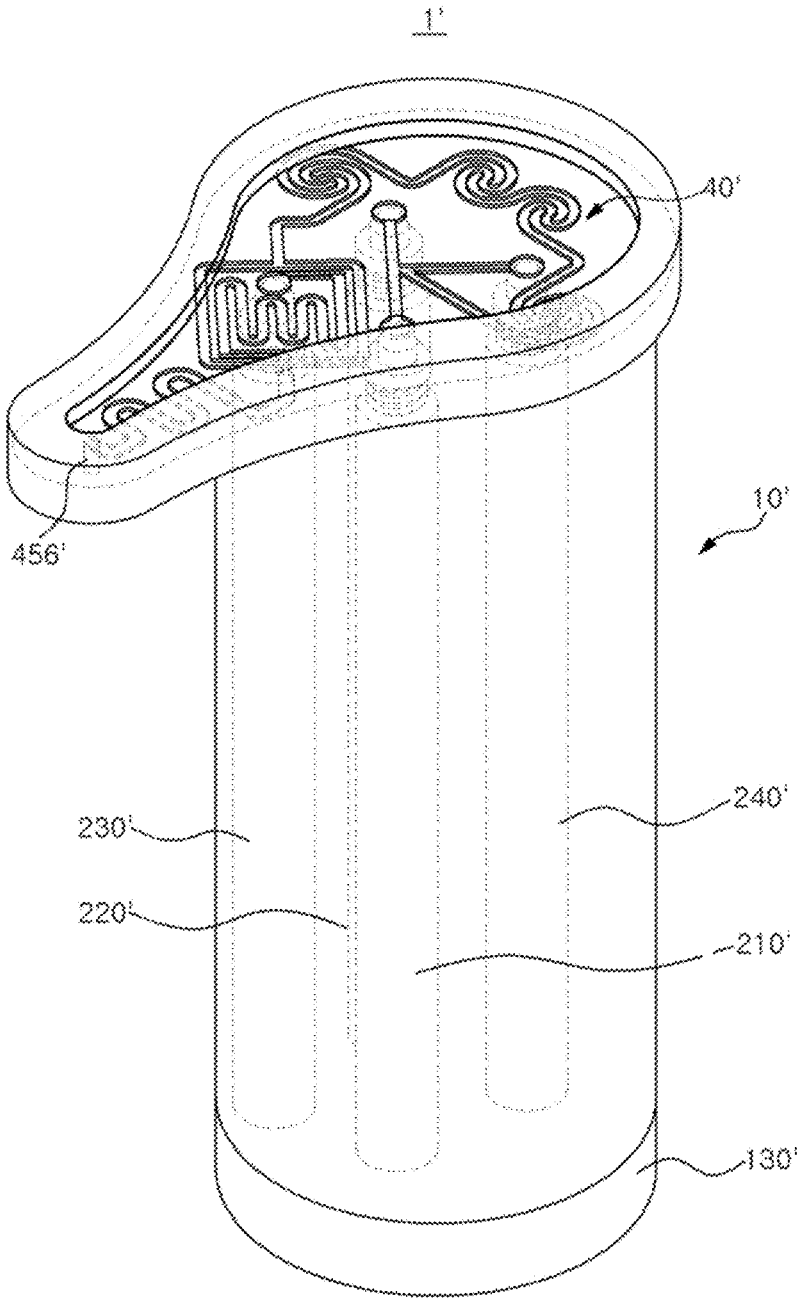

【FIG. 9】
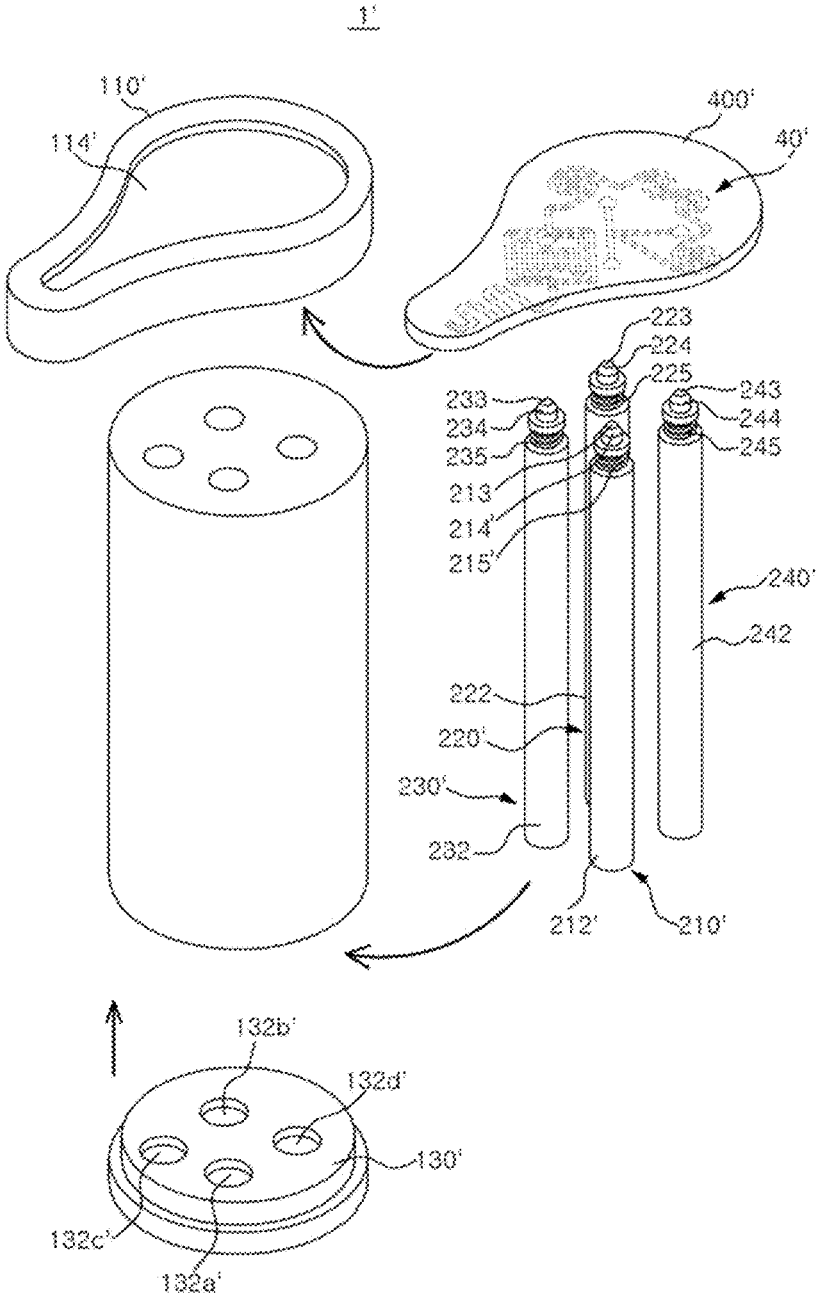

【FIG. 10】
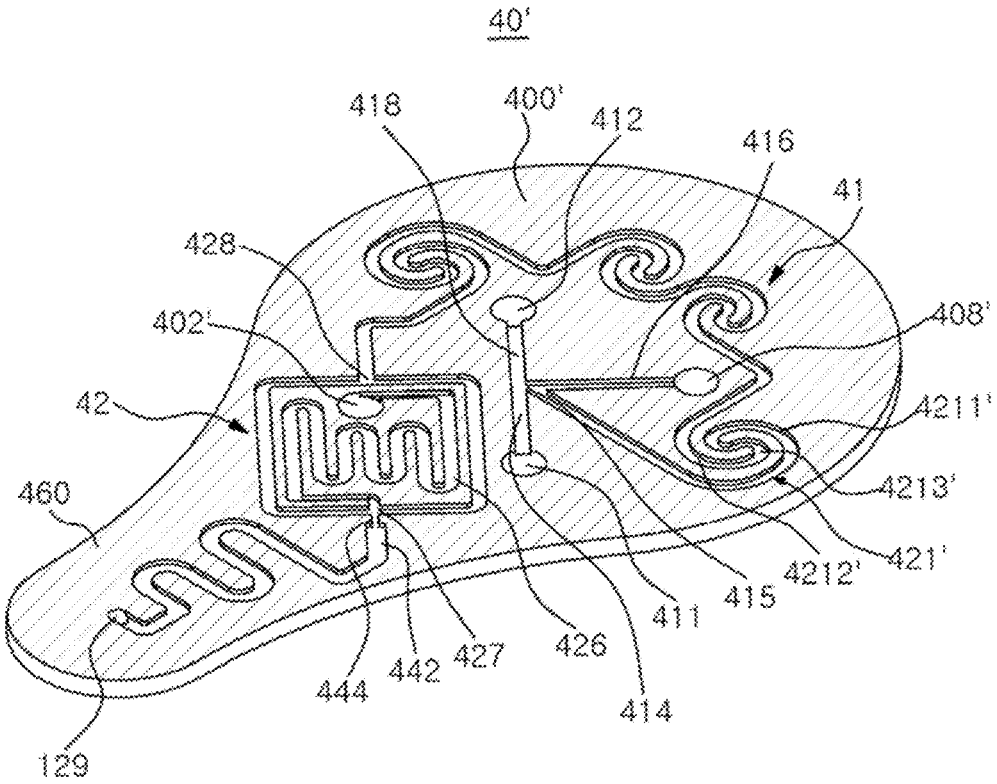

【FIG. 11】
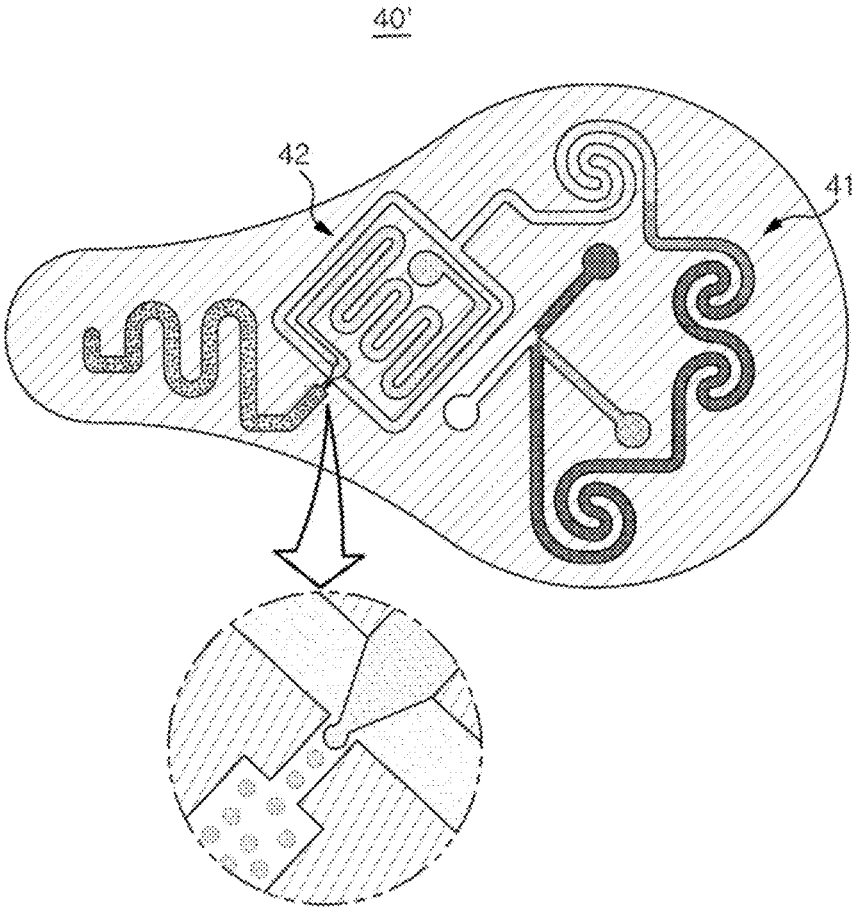

【FIG. 12】
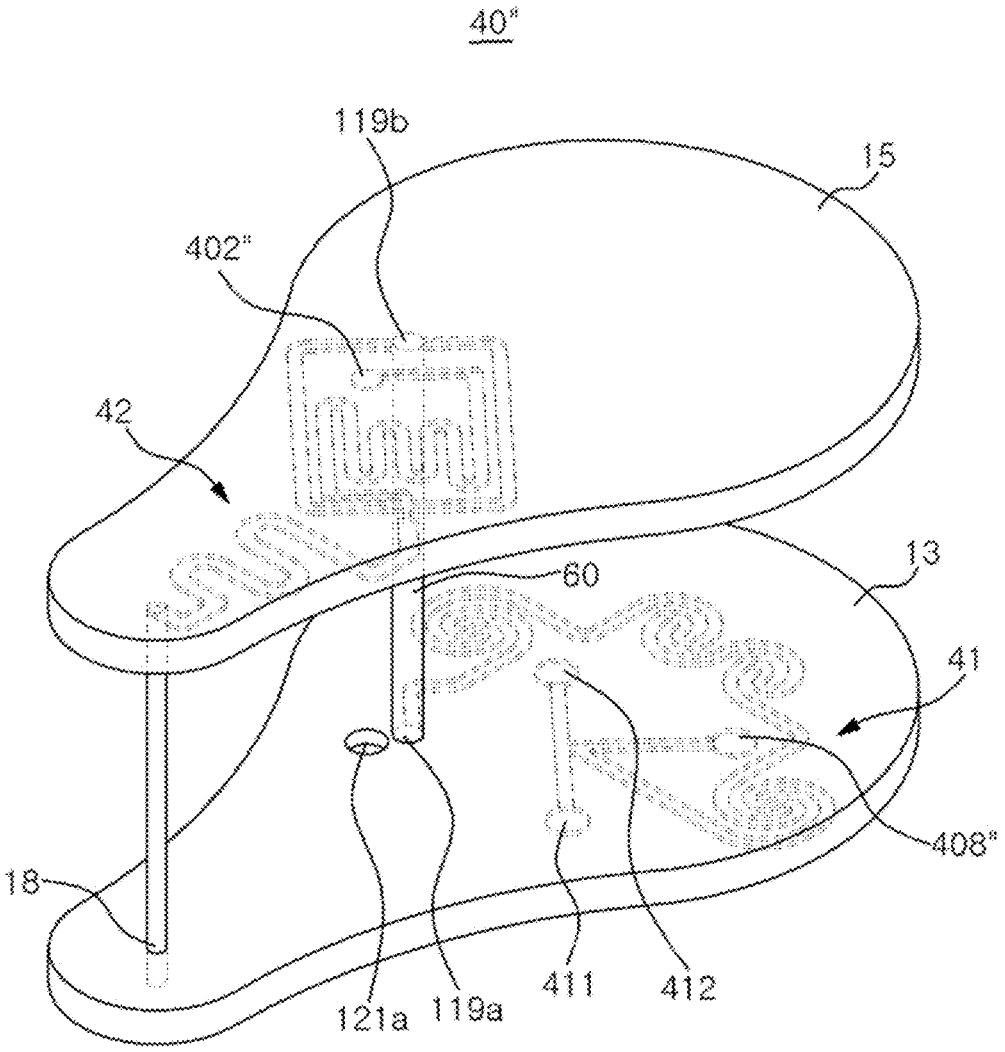

APPARATUS FOR MANUFACTURING COSMETIC USING INSTANTANEOUS EMULSIFICATION

CROSS-REFERENCES TO RELATED APPLICATION

This application is based on and claims priority of Korean Patent Application No. 10-2018-0174274, filed on Dec. 31, 2018 with the Korean Intellectual Property Office, the entire contents of which are hereby incorporated by reference.

TECHNICAL FIELD

The present invention relates to an apparatus for manufacturing cosmetic using instantaneous emulsification.

BACKGROUND

With the growing interest of people in skin care, demand for customized cosmetic which has effects or feeling of use that a user wants is increasing.

In order to satisfy such demand, there have been attempts to realize customized cosmetic which matches with a user's preference and use purpose. For example, in order to provide customized cosmetic in prior art, a method which allows a user to select among cosmetics having various effects, which have been already manufactured, a method which uses cosmetic having one basic formulation after adding other cosmetic thereto, or a method which simply stirs two or more cosmetics having completed formulations or adjust a ratio (using dual container, dial container, mixture, discharging machine or the like) has been used.

However, the method which has a user select among ready-made cosmetics cannot sufficiently satisfy demand of customers who use customized cosmetic perfectly suitable for them.

Further, in a case where a cosmetic having one basic formulation is used after adding another cosmetic thereto, it is disadvantageously difficult to use it as customized cosmetic after one-time stirring has done.

Further, with regard to the method in which completed formulations are stirred, there is a limit to free formulation selection of customers, and external driving force is required in order to mix formulations of high viscosity, which lays obstacle in the way of being portable.

Meanwhile, fluid emulsification technology means that one of two fluids which are not mixed with each other like water and oil is dispersed in small particle form to be stably disposed within the other fluid. Such emulsification technology is widely used in the manufacture field of cosmetics, such as lotion, cream, essence, massage cream, cleansing cream, make-up base, foundation, eyeliner, mascara or the like.

Specifically, cosmetic may include O/W (oil in water) emulsion which is manufactured by dispersing hydrophobic fluid, such as oil, uniformly in a small particle state in the hydrophilic fluid, such as water, or W/O (water in oil) emulsion which is manufactured by dispersing hydrophilic fluid uniformly in a small particle state in the hydrophobic fluid. In the emulsion manufacture process, surfactant or thickener is used in order to improve productivity, product quality or the like.

In order to produce emulsion, it is necessary to suitably mix internal phase fluid which is dispersed in a micro particle form with continuous external phase fluid which surrounds micro particles. However, there is a drawback that ready-made emulsion cannot satisfy desire of customers who want to use fresh cosmetic.

Further, customers prefer to use products which contain minimum additional materials, such as surfactant, thickener or the like, which is a chemical material having no close relation to origin function of cosmetic. However, there is a problem that since stability of product should be maintained for a long time from manufacture of cosmetic to the time of use, a certain amount of additional material need to be added to cosmetic for this.

SUMMARY

Exemplary embodiments of the invention, which have been conceived to address above-described problems, provides an apparatus for manufacturing cosmetic using instantaneous emulsification, which enables a user to directly manufacture cosmetic having components exhibiting desirable effects, feeling of use, content ratio.

Further, exemplary embodiments of the invention provide an apparatus for manufacturing cosmetic using instantaneous emulsification, which is miniaturized and lightweight to be potable.

Further, exemplary embodiments of the invention provide an apparatus for manufacturing cosmetic using instantaneous emulsification, which is capable of satisfying customer's desire for fresh cosmetics.

Further, exemplary embodiments of the invention provide an apparatus for manufacturing cosmetic using instantaneous emulsification, which reduces content of additional materials used to maintain stability of a product for a long time.

According to an aspect of the present invention, there is provided an apparatus for manufacturing cosmetic using instantaneous emulsification, the apparatus comprising: a housing which forms an outer appearance; an internal phase container which is replaceably coupled to the housing, and which stores internal phase fluid; an external phase container which is replaceably coupled to the housing, and which stores external phase fluid; a channel unit which generates emulsion by mixing the internal phase fluid provided from the internal phase container and the external phase fluid provided from the external phase container; and an operative unit which provides external force required to form and discharge emulsion at the channel unit by manipulation of a user, wherein the internal phase container and the external phase container have a pumping part which is operated by action of the operative unit, and wherein the operative unit presses the pumping part of the internal phase container and the pumping part of the external phase container at the same time by external force to discharge the internal phase fluid stored in the internal phase container and the external phase fluid stored in the external phase container to the channel unit.

Further, there is provided an apparatus for manufacturing cosmetic using instantaneous emulsification, wherein each of the internal phase container and the external phase container is provided one or more in number, and wherein by one-time operation of the operative unit, total discharging amount of the external phase fluid discharged from the external phase container is greater than total discharging amount of the internal phase fluid discharged from the internal phase container.

Further, there is provided an apparatus for manufacturing cosmetic using instantaneous emulsification, wherein the internal phase fluid and the external phase fluid exclude surfactant.

Further, there is provided an apparatus for manufacturing cosmetic using instantaneous emulsification, wherein the channel unit is provided as a continuous single layer path formed in one or more plates, and includes a mixing section which has a plurality of mixing parts with a direction converting path capable of converting a rotational direction of fluid.

Further, there is provided an apparatus for manufacturing cosmetic using instantaneous emulsification, further comprising a functional container which is replaceably coupled to the housing, and which stores functional fluid, wherein the functional container includes a pumping part which is driven by operation of the operative unit at the same time with the pumping part of the internal phase container and the pumping part of the external phase container, and which discharges the functional fluid to the channel unit.

Further, there is provided an apparatus for manufacturing cosmetic using instantaneous emulsification, wherein containers provided as the internal phase container and the external phase container have same size and discharging amount, and are replaceably provided to the housing.

Further, there is provided an apparatus for manufacturing cosmetic using instantaneous emulsification, wherein each of the internal phase container and the external phase container includes: a storing part which stores fluid; a pumping part which is moved by the operative unit to form pressure for discharging the fluid; an elastic member which provides restoring force to the pumping part; and a discharging end portion for discharging fluid stored in the storing part to the channel unit.

Further, there is provided an apparatus for manufacturing cosmetic using instantaneous emulsification, wherein inside of the storing part is provided with a chamber having a space whose volume is changed according to movement of the pumping part so as to generate pressure for discharging fluid.

Further, there is provided an apparatus for manufacturing cosmetic using instantaneous emulsification, wherein the operative unit includes a sliding surface which slides along an inner surface of the housing so as to move along the inner surface of the housing by external force.

Further, there is provided an apparatus for manufacturing cosmetic using instantaneous emulsification, wherein the operative unit includes pressing surfaces which are capable of pressing the pumping parts of the internal phase container and the external phase container at the same time.

Further, there is provided an apparatus for manufacturing cosmetic using instantaneous emulsification, wherein the operative unit includes a plurality of flow paths which are capable of transferring to the channel unit the internal phase fluid discharged from the internal phase container, and the external phase fluid discharged from the external phase container.

Further, there is provided an apparatus for manufacturing cosmetic using instantaneous emulsification, wherein the channel unit includes: a confluence part in which the internal phase fluid provided from the internal phase container and the external phase fluid provided from the external phase container are mixed with each other; and a mixing section including a plurality of the mixing parts which are continuously disposed around the confluence part, and which generate emulsion particles by converting proceeding direction of fluid and thus forming vortices in flow.

Further, there is provided an apparatus for manufacturing cosmetic using instantaneous emulsification, wherein the mixing part includes: a first rotation path for guiding an entering fluid to be rotated in one direction; a second turning path which guides the fluid rotating in one direction to be rotated in another direction; and a direction converting path which changes a rotational direction of fluid between the first turning path and the second turning path.

Further, there is provided an apparatus for manufacturing cosmetic using instantaneous emulsification, wherein the mixing part which is formed on the channel unit is provided three or more in number.

Further, there is provided an apparatus for manufacturing cosmetic using instantaneous emulsification, wherein the internal phase container and the external phase container include a cartridge which is separably and replaceably coupled to the housing.

According to an embodiment of the invention, there is an advantage that an apparatus for manufacturing cosmetic using instantaneous emulsification enables a user to directly manufacture cosmetic having components exhibiting desirable effects, feeling of use, content ratio.

Further, it is also advantageous to provide an apparatus for manufacturing cosmetic using instantaneous emulsification, which is miniaturized and lightweight to be potable.

Further, it is also advantageous to provide an apparatus for manufacturing cosmetic using instantaneous emulsification, which is capable of satisfying customer's desire for fresh cosmetics.

Further, it is also advantageous to provide an apparatus for manufacturing cosmetic using instantaneous emulsification, which reduces content of additional materials used to maintain stability of a product for a long time.

BRIEF DESCRIPTION OF THE DRAWINGS

FIG. 1 is a schematic perspective view showing a configuration of an apparatus for manufacturing cosmetic using instantaneous emulsification according to an embodiment of the present invention.

FIG. 2 is an exploded perspective view of FIG. 1.

FIG. 3 is a cross sectional view of FIG. 1.

FIG. 4 is a cross sectional view of a container of FIG. 2.

FIG. 5 is a cross sectional view showing a channel unit of FIG. 2.

FIG. 6 is a micrograph showing an emulsion particle of an emulsion composition manufactured using the apparatus for manufacturing cosmetic using instantaneous emulsification of FIG. 1.

FIG. 7 is a conceptual diagram for designing a vortex promoting path of FIG. 1.

FIG. 8 is a schematic perspective view showing a configuration of an apparatus for manufacturing cosmetic using instantaneous emulsification according to another embodiment of the present invention.

FIG. 9 is an exploded perspective view of FIG. 8.

FIG. 10 is a perspective view showing a channel unit of FIG. 8.

FIG. 11 is a diagram showing a path of a channel unit of FIG. 10, through which a fluid flows.

FIG. 12 is a schematic perspective view showing a configuration of the channel unit of an apparatus for manufacturing cosmetic using instantaneous emulsification according to another embodiment of the present invention.

DETAILED DESCRIPTION

Hereinafter, specific exemplary embodiments of the invention will be described in detail with reference to the drawings. Additionally, it is noted that when describing the invention, the detailed description for known configurations or functions may be omitted herein so as not to obscure essential points of the disclosure.

FIG. 1 is a schematic perspective view showing a configuration of an apparatus for manufacturing cosmetic using instantaneous emulsification according to an embodiment of the present invention, FIG. 2 is an exploded perspective view of FIG. 1, FIG. 3 is a cross sectional view of FIG. 1, FIG. 4 is a cross sectional view of a container of FIG. 2, and FIG. 5 is a cross sectional view showing a channel unit of FIG. 2.

Referring to FIGS. 1 to 5, an apparatus 1 for manufacturing cosmetic using instantaneous emulsification according to an embodiment of the present invention may mix and instantly emulsify fluids stored in a plurality of containers. Herein, the term "instantaneous emulsification" may be understood as emulsifying an internal phase fluid into an external phase fluid, and maintaining the emulsified state for a predetermined period of time. That is, the apparatus 1 for manufacturing cosmetic using instantaneous emulsification according to an embodiment of the invention may be an apparatus which instantly emulsifies a plurality of raw materials within a few seconds, and supplies it to a user at once.

Further, the apparatus 1 for manufacturing cosmetic using instantaneous emulsification may produce an O/W emulsion or a W/O emulsion according to a mixing ratio of fluids stored in a plurality of containers. For example, if fluids to be mixed are an oil-based fluid and a water-based fluid, and they are mixed at such a mixing ratio that the amount of the water-based fluid is more than that of the oil-based fluid, the O/W emulsion can be produced. In an opposite case, the W/O emulsion can be produced.

Specifically, the apparatus 1 for manufacturing cosmetic using instantaneous emulsification according to an embodiment of the invention may include a housing 10 which forms its outer appearance, a plurality of containers 20 which are provided inside the housing 10 and store at least two different fluids from each other, a channel unit 40 which provides a space where the fluids discharged from the plurality of containers 20 are mixed with each other, and an operative unit 30 which provides pressure for discharging the emulsion produced in the channel unit 40.

In the embodiment, the operative unit 30 is described by way of example as pressing the plurality of containers 20 at the same time to activate pumping units provided in the containers 20. However, the technical idea of the invention is not limited to this. Further, in the embodiment, the activation of the operative unit 30 produces pressure, which enables the discharge of the fluids from the containers 20 to the channel unit 40 and the discharge of the emulsion from the channel unit 40 to the outside. However, the technical idea of the invention is not limited to this, and according to an embodiment, the operative unit 30 may be provided with a configuration for discharging the fluid from the container 20 to the channel unit 40, and a configuration for discharging the emulsion from the channel unit 40 to the outside, separately. In a case where the single operative unit 30 activates the pumping units provided in the plurality of containers 20 at the same time as in the embodiment, the convenience for use can be improved, and it becomes easy to design the channel unit 40.

The housing 10 may be formed in a predetermined shape which accommodates the plurality of containers 20, and the housing 10 is described by way of example as being formed in a cylindrical shape in the embodiment. However, the housing 10 may have a rectangular parallelepiped shape, and there is no limit to its shape.

The housing 10 may include a lid 110 which covers a portion of the channel unit 40 to be described later, a main body 120 which accommodates the containers 20 therein, and a supporting part 130 which supports a bottom side of the container 20.

The lid 110, which surrounds a portion of the channel unit 40, may be formed with a transparent material so that a user can see the fluid flowing in the channel unit 40. Further, an upper portion of the lid 110 may include an opening 114, so that the user can see a portion or whole of the channel unit 40. For example, the opening 114 may be a circular or rectangular hole. However, there is no limit in its shape. The provision of the opening 114 enables a user to confirm emulsification with the naked eye, so reliability for a product can be improved.

Further, the main body 120 may include a neck part 122 which is coupled with the operative unit 30, and an insertion part 124 which is formed opposite to the neck part 122 to be coupled with the supporting part 130, and which provides a space through which the container 20 can be inserted.

The supporting part 130 may be removably coupled with the insertion part 124 for substitution of the container 20, and may support a lower part of the container 20 when being coupled therewith, so that the container 20 can be stably fixed in the housing 10.

The supporting part 130 may include a plurality of grooves 132 for fixing each of the containers 20 which have been installed in the housing 10. The plurality of grooves 132 may be formed having such a depth as to stably support containers 20. Further, the plurality of grooves 132 formed in the supporting part 130 may correspond to the number and the locations of the containers 20.

The containers 20 include an internal phase container storing an internal phase fluid, and an external phase container storing an external phase fluid. For example, the containers 20 may include a first container 210 storing an internal phase fluid, and a second container 220 storing an external phase fluid. In the embodiment, the containers 20 are described by way of example as being four, but the number of the containers is not limited as long as there are provided a container which can store an internal phase fluid independently, and a container which can store an external phase fluid independently. Herein, the container 20 may be detachable to the housing 10, and may be configured such that the container 20 can be refilled with a fluid or a fluid inside the container can be substituted with another. For example, the container 20 may be a cartridge.

In the embodiment, the type of emulsion (e.g., W/O emulsion or O/W emulsion) may be determined according to a ratio at which a plurality of fluids is supplied to the channel unit 40. And, the ratio at which fluids are supplied to the channel unit 40 may be adjusted by the number or the discharging amount of the containers 20 supplying the corresponding fluids. For example, in a case where oil and water are supplied to the channel unit 40, if the supply amount of oil is greater than that of water, W/O emulsion will be produced, while, if the supply amount of water is greater than that of oil, O/W emulsion will be produced.

The plurality of containers 20 may be provided in such a combination as to form an internal phase fluid and an external phase fluid at the time of instantaneous emulsification in the channel unit 40. In the embodiment, the two containers are described by way of example as storing an external phase fluid, so that more amount of external phase fluid can be supplied to the channel unit 40. According to an embodiment, a single container which can discharge relatively more amount may be provided as the second container 220, and in this case, only the single container may be used as a container storing an external phase fluid.

In the embodiment, the apparatus 1 for manufacturing cosmetic using instantaneous emulsification may include the first container 210 storing an internal phase fluid, the second container 220 storing an external phase fluid, a third container 230 storing a functional fluid, and a fourth container 240 storing another external phase fluid. The embodiment is described by way of example as oil being used as the internal phase fluid and water being used as the external phase fluid, and thus the first container 210 may store an oil-based fluid, the second container 220 and the fourth container 230, which can be selectively provided, may store a water-based fluid. In this case, the first container 210 may be understood as an internal phase container as it stores an internal phase fluid, and the second container 220 and the fourth container 240 may be understood as an external phase container as they store an external phase fluid. Further, it can be understood that the amount of the external phase fluid supplied to the channel unit 40 from the external phase container is greater than that of the internal phase fluid supplied to the channel unit 40 from the internal phase fluid. For this, the number of the internal phase containers and the number of the external phase containers may be adjusted according to an embodiment. Additionally, the third container 230 may be understood as a functional container as it stores a functional fluid.

When the oil-based fluid and the water-based fluid are discharged at a ratio of 1:2 to be emulsified in the channel unit 40, an O/W emulsion can be formed. Herein, discharging amounts of the pumping units to be described later may be set to be equal to each other, so that each container can discharge the same amount of fluid.

In contrast to this, when the first container 210 stores a water-based fluid, and the second container 220 and the fourth container 240, which is provided selectively, store an oil-based fluid, a W/O emulsion can be produced.

Meanwhile, the third container 230 storing a functional fluid may be also provided selectively. In the embodiment, the functional fluid may be understood as a raw material which is included in cosmetic components for functional improvement, and particularly, a raw material which is legally approved with respect to functions. Further, the functional fluid may be also understood as meaning a fluid in which a functional raw material is dissolved or included.

Hereinafter, structure of the first container 210 will be described in detail. The other containers 220, 230, 240 may have the same structure, shape, size and function as the first container 210, so detailed description of the containers 220, 230, 240 will be omitted.

The first container 210 may include a storing part 212 storing a fluid therein, a pumping part 214 which is provided at one side of the storing part 212, and which performs a pumping action by being moved by the operative unit 30, an elastic member 215 which provides restoring force to the pumping part 214, a tube 211 which is provided inside the storing part 212 and connected to the pumping part 214, and through which a fluid can be intaken, and a discharging end 219 through which the fluid intaken through the tube 211 is discharged to the outside (see FIG. 4).

The storing part 212 provides a space S in which a fluid is stored, and may have such a three-dimension shape as to be inserted into the inside of the main body 120. The storing part 212 may be provided so as to be charged with fluid, and an opening for charging is provided by removing the pumping part 214, but may be formed by removing a lower part of the storing part.

In the storing part 212, a chamber 216 may be provided for providing a space whose volume is changed, so that the pumping action can take place. The volume of the chamber 216 may be changed by movement of the pumping part 214.

The pumping part 214 is a component which is pressed and moved by the operative unit 30 to produce pumping pressure, and may be provided, such that it can be moved inward and outward of the chamber 216 while changing the volume of the chamber 216.

The chamber 216 may be provided with a first valve 217 at one side, which selectively opens and closes an inner space of the chamber 216 to control the intake of the fluid through the tube 211, and a second valve 218 at the other side of the chamber 216, which selectively opens and closes an inner space of the chamber 216 to control the discharge of the fluid through the discharging end 219.

The tube 211 may be provided so as to extend from a point of the chamber 216 toward the bottom of the storing part 212, and sufficiently intake fluid stored in the storing part 212.

The discharging end 219 may be formed so as to extend to the chamber 216 penetrating through the pumping part 214, and may have a shape protruding from the pumping part 214 by a predetermined length for connection with a flow path 33 to be described later.

With such configuration, the container 210 may be operated as below. When the pumping part 214 is pressed down by being subjected to a force, the volume of the inner space of the chamber 216 is decreased, and the pressure of the inner space of the chamber 216 is increased. Due to such pressure change, the first valve 217 can operate so as to close a flow path, and the second valve 218 can operate so as to open a flow path, and thus the fluid stored in the inner space of the chamber 216 can be discharged through the discharging end 219. And, while the pumping part 214 is returned to its original position by action of the elastic member 215, the volume of the inner space of the chamber 216 is increased and the pressure of the inner space of the chamber is decreased. Due to this, the first valve 217 can operate so as to open the flow path, and the second valve 218 can operate so as to close the flow path, and thus the fluid of the storing space S can be introduced to the inner space of the chamber 216 through the tube 211. FIG. 4 may be understood as a schematic diagram for illustrating the above-mentioned operation.

The operation of the first container 210 may be performed by the movement of the operative unit 30, and the other containers 220, 230, 240 may be operated similarly.

Meanwhile, the discharging amounts of the first, second, third and fourth containers 210, 220, 230, 240 by the movement of the operative unit 30 may be set to be equal to each other. Herein, the discharging amount may be understood as an amount of fluid which is discharged from each container 210, 220, 230, 240 to the outside by a single press of each pumping part 214, 224, 234, 244. That is, the equal discharging amount of a container means that amounts of fluid discharged from each container 210, 220, 230, 240 to the outside by the single press of the operative unit 30 are equal to each other.

For example, the discharging amount of each container 210, 220, 230, 240 by the single press may be 0.01 cc to 0.1 cc. However, the discharging amount is not limited to this, and 0.1 cc or more may be discharged by a single press.

Further, discharging pressure of each container 210, 220, 230, 240 may be set to such a level that fluid can be discharged from the container 210, 220, 230, 240, pass through the channel unit 40 while being emulsified, and then can be discharged from the channel unit 40 to the outside. For example, the discharging pressure may be 1.5 kpa.

Meanwhile, the operative unit 30 may provide an external force required to form emulsion in the channel unit 40 and discharge the emulsion to the outside. In the embodiment, the operative unit 30 is described by way of example as being a pressing means of a plate form which receives and transfers force from the lid 110 to the containers 210, 220, 230, 240 to generate pressure for pumping. Technical idea of the invention is not limited to this, and the operative unit 30 may be provided with another mechanical mechanism or an electronic driving device.

Specifically, the operative unit 30 may be provided as a means which is disposed between the pumping parts 214, 224, 234, 244 of the containers 210, 220, 230, 240 and the channel unit 40 to be capable of pressing the pumping parts 214, 224, 234, 244. Herein, the operative unit 30 may serve as moving fluid discharged from the containers 210, 220, 230, 240 to the channel unit 40.

When the operative unit 30 is subjected to a downward force by a user pressing down the lid 110, the operative unit 30 can press the pumping parts 214, 224, 234, 244 of the containers 20. Specifically, the operative unit 30 may include a pressing surface 32 which contacts the pumping parts 214, 224, 234, 244. Herein, the pressing surface 32 may serve as a stopping part which determines an upper position of the container 20.

Further, the operative unit 30 may include a plurality of flow paths 33 through which fluid can be transferred from the container 20 to the channel unit 40. Each flow path 33 may be disposed so as to correspond to the position of each container 20, and may be penetratingly formed in an up and down direction to allow the fluid supplied from the below to move to the channel unit 40 at an upper side.

Further, the operative unit 30 may include a sliding surface 34 which slides along an inner surface of the main body 120, so that it can be moved along the inner surface of the main body 120 by an external force. The sliding surface 34 may be formed so as to surround the inside or outside of the main body 120, and an upper end inner surface of the main body 120 may serve as a guide surface.

The operative unit 30 may be elastically supported by the first elastic member 123*a* provided at a portion of the container main body 120. Further, at the neck part 122 of the container main body 120, a second elastic member 123*b* may be formed, which supports a portion of the operative unit 30. Specifically, a central portion of the operative unit 30 may be supported by the first elastic member 123*a*, and a circumferential portion of the operative unit 30 may be supported by the second elastic member 123*b*. Herein, elastic modulus of the first elastic member 123*a* may be greater than that of the second elastic member 123*b*. However, this is an example, and the elastic modulus of the second elastic member 123*b* may be greater than that of the first elastic modulus 123*a*.

Further, a force which restores the operative unit 30 to its original position may be provided by the elastic member 215 provided at the container 20.

The above-described operative unit 30 and the pumping parts provided at the containers 20 can produce pressure, and produce and discharge emulsion only with the mechanical construction without any electronic device. Therefore, the apparatus 1 for manufacturing cosmetic using instantaneous emulsification can be manufactured in such a small size as to be portable. Particularly, as each container 20 is separately provided with the pumping part, magnitude of pressure which the pumping part should provide can be minimized, and thus the pumping part can be realized with a minimum size, which in turn can lead to miniaturization of the apparatus 1 for manufacturing cosmetic using instantaneous emulsification.

Further, as the containers 20 may be provided in a replaceable manner, a user can selectively use the container 20 which stores a raw material that the user desires. Therefore, the user's satisfaction with the product can be increased.

Meanwhile, the fluid stored in the above-described container 20 may not include a surfactant.

Herein, the surfactant may be defined as a compound that has a hydrophilic portion which is likely to be dissolved in water, and a hydrophobic portion which is likely to be dissolved in oil, and that helps fluids, which are not easily mixed due to high surface tension of interfaces, to be mixed with each other. In the embodiment, the surfactant may be understood as an emulsifier.

Conventional cosmetics required surfactant in order to mix an internal phase fluid and an external phase fluid which are based on water and oil. However, according to an embodiment of the invention, there is provided the channel unit 40 which is capable of supplying emulsion by mixing and instantly emulsifying the internal phase fluid and the external phase fluid, and thus it is possible to produce emulsion without adding a surfactant. Specifically, the channel unit 40 is supplied with fluids from the plurality of containers 20 and can provide instantaneously emulsified emulsion.

Configuration of the channel unit 40 capable of producing emulsion by forming emulsion particles without using a surfactant will now be described. However, such channel unit 40 is not necessarily to be applied only to an internal phase fluid and an external phase fluid which do not use a surfactant. That is, according to an embodiment, there may be provided an apparatus for manufacturing cosmetic using instantaneous emulsification which employs the configuration of the channel unit 40 and uses an internal phase fluid, an external phase fluid or a functional fluid which includes a surfactant. In this case, effect of forming emulsion particles at the channel unit 40 can be further improved, and in some cases, a mixing section 420 of the channel unit 40 may be formed with a shorter length, or the number of mixing parts 421, 422, 423, 424, 425 may be less than three.

Meanwhile, the configuration of the channel unit 40 is suggested for forming emulsion particles without using a surfactant, and the channel unit 40 having another configuration may be used when a surfactant is used.

The channel unit 40 according to the embodiment provides a microfluidic channel formed in the channel unit 40, through which the internal phase fluid and the external phase fluid pass to be emulsified. The microfluidic channel of the channel unit 40 may be provided inside a plate 400, and the plate 400 may have a flat board shape. That is, the microfluidic channel of the channel unit 40 is disposed inside the plate 400 having a flat board shape, and thus the microfluidic channel can be located on the same plane inside the plate 400. As described above, the microfluidic channel is located on a single flat plate, and thus the apparatus for manufacturing cosmetic can be miniaturized.

For example, a cross section of the microfluidic channel (cross section of a flow path) formed inside the channel unit 40 may be a rectangular whose sides are 0.5 mm to 1 mm. The cross section of the microfluidic channel (flow path) may be a circle whose diameter is 0.5 mm to 1 mm. As described above, when flow path inside the channel unit 40 is formed with the microfluidic channel, the flow speed of the fluid can increase, thus increasing the mixture of fluids and efficiency of emulsification. However, the cross section shape of the microfluidic channel is not limited to the shape described above.

According to the embodiment, the channel unit 40 may include an internal phase fluid injection hole 402 to which an internal phase fluid is supplied from the first container 210, a first external phase fluid injection hole 404 to which an external phase fluid is supplied from the second container 220, a confluence part 410 where the internal phase fluid supplied from the internal phase fluid injection hole 402 and the external phase fluid supplied from the first external phase fluid injection hole 404 are joined while emulsion particles are formed, a mixing section 420 which extends from the confluence part 410, and which includes a plurality of mixing parts 421, 422, 423, 424, 425 formed so as to generate vortices in flow by converting a proceeding direction of the fluid, and a particle size adjusting part 430 which makes uniform sizes of emulsion particles included in the fluid introduced from the mixing section 420.

Herein, the confluence part 410, the mixing section 420 and the particle size adjusting part 430, which are microfluidic channels, may be understood as a flow path extending by a predetermined length through which the fluid can move, and may be formed inside the plate 400. These microfluidic channels may serve as increasing the flow speed inside the channel in proportion to the reduction of cross section area, when a fluid is introduced into the channel unit 40 from the container 20. Further, by changing shapes of the microfluidic channels inside the plate 400 of a small surface area, it is possible to easily increase the contacting surface area or contacting time between two phases (internal phase fluid and external phase fluid). Further, the governing force of the surface tension in the microfluidic channel is much greater compared to macro environments.

Further, the channel unit 40 may include a first connecting flow path 403 which connects the internal phase fluid injection hole 402 with the confluence part 410, and a second connecting flow path 405 which connects the first external phase fluid injection hole 404 with the confluence part 410. In this case, an angle between the first connecting flow path 403 and the second connecting flow path 405 may be 80°-100°.

In a case where the internal phase fluid and the external phase fluid meet with each other in the confluence part 410 at the above-mentioned angle, a portion of the internal phase fluid may be broken before entering the mixing section 420. This may have a good effect on the formation of emulsion particles to contribute to the formation of emulsion.

Further, after the internal phase fluid and the external phase fluid have been mixed with each other in the confluence part 410, the mixture may be introduced into an initial flow path 429 of the mixing section 420.

For example, both an angle between the first connecting flow path 403 and the initial flow path 429 and an angle between the second connecting flow path 405 and the initial flow path 429 may be 135°.

Further, the channel unit 40 may include a functional fluid injection hole 408 to which a functional fluid is supplied from the third container 230, and a second external phase fluid injection hole 406 to which an external phase fluid is supplied from the fourth container 240. Further, the channel unit 40 may include a third connecting flow path 409 which connects the functional fluid injection hole 408 with the confluence part 410, and a fourth connecting flow path 407 which connects the second external phase fluid injection hole 406 with the confluence part 410. These configurations may be selectively provided according to whether the third container 230 or the fourth container 240 is provided or not.

An angle between the third connecting flow path 409 and the second connecting flow path 405 may be 80°-100°. Further, in a case where the functional fluid injection hole 408 is formed near the internal phase fluid injection hole 402, an angle between the third connecting flow path 409 and the first connecting flow path 403 may be 80°-100°.

Further, in a case where both the third container 230 storing a functional fluid, and the fourth container 240 storing another external phase fluid are provided, the first connecting flow path 403, the second connecting flow path 405, the third connecting flow path 409 and the fourth connecting flow path 407 may be disposed so as to form the same angle between themselves.

Meanwhile, in the embodiment, all the flow paths are described by way of example as being joined at one point, but according to an embodiment, confluence points of flow paths may be different from each other. That is, the confluence part 410 may be configured to have a plurality of confluence points.

Further, the plate 400 may be transparent, so that fluids can be seen flowing in the channel unit 40.

The mixing section 420 may include a plurality of the mixing portions 421, 422, 423, 424, 425, which extend from the confluence part 410, and which form vortices in flow by converting a proceeding direction of fluid.

The mixing parts 421, 422, 423, 424, 425 may be a flow path which can form vortices in flow by converting a proceeding direction of fluid, for example, a turning direction of fluid by a flow path. One mixing part may be understood as having one or more flow paths which covert a turning direction. For this, the mixing parts 421, 422, 423, 424, 425 may include a bent part, a curved part, a turning part and the like which can convert the proceeding direction of fluid. Particularly, in a case where the mixing parts 421, 422, 423, 424, 425 are formed so as to make fluid to turn one direction or both directions, the fluid is subjected to centrifugal force while vortices are being formed in the fluid, and thus the fluid can be mixed and emulsified at the same time while passing through the mixing parts 421, 422, 423, 424, 425.

Specifically, the vortices generated in the mixing parts 421, 422, 423, 424, 425 impart complex movements to the mixed fluids, and the movement of the external phase fluid governs the flow in the vortices as relatively more external phase fluid has been supplied. Such movements of the external phase fluid may be exerted on the internal phase fluid in such a manner as to make the flow of internal phase fluid thinner or break the flow of the internal phase fluid. Such exertions may be generated in each of all the mixing parts 421, 422, 423, 424, 425, and, in the channel unit 40 of a plate shape as in the embodiment, it is preferable to be subjected to three or more vortex generation sections in order to achieve emulsification to such an extent as to be suitable as cosmetics.

In the embodiment of the invention, there may be provided three or more mixing parts. In the embodiment of the invention, the mixing parts are described by way of example as being five in number (first mixing part 421, second mixing part 422, third mixing part 423, fourth mixing part 424, fifth mixing part 425). Herein, if the fluid has passed through the first to third mixing parts 421, 422, 423, it may be emulsified to such an extent as to be used as a cosmetic, and the fourth and fifth mixing parts 424, 425 may be used as an element which determines quality of formulation supplied to a user, by additionally emulsifying or mixing.

That is, as necessary, the mixing part after the third mixing parts 423 may be selectively provided.

In the embodiment, the mixing parts 421, 422, 423, 424, 425 may be disposed on an outer circumference of the confluence part 410. In other words, when the plate constituting the channel unit 40 is viewed from the top, that is, when viewed from a viewpoint of FIG. 5, the mixing parts 421, 422, 423, 424, 425 may be arranged so as to surround the confluence part 410. That is, the mixing parts 421, 422, 423, 424, 425 may be disposed on a region between the confluence part 410 and the periphery of the plate 400. As described above, by arranging the mixing parts 421, 422, 423, 424, 425 on the region near the periphery of the plate 400, the length of the microfluidic channel of the mixing section 420 can be sufficiently elongated, and thus sufficient emulsification can be achieved even in a small-size plate. Thereby, the apparatus 1 for manufacturing cosmetic using instantaneous emulsification can be realized in a small size so as to be portable without burden.

The plurality of mixing parts 421, 422, 423, 424, 425 may be disposed in an order of the first mixing part 421, the second mixing part 422, the third mixing part 423, the fourth mixing part 424 and the fifth mixing part 425 from upstream connected with the confluence part 410 to downstream connected with the particle size adjusting part 430. Specifically, the mixing parts 421, 422, 423, 424, 425 may be generally arranged in a rotational manner in one direction (in the embodiment, a clockwise direction) with the confluence part 410 as a center. Herein, the first mixing part 421 and the third mixing part 423 may be disposed at opposite sides with respect to the confluence part 410, and the second mixing part 422 may connect the first mixing part 421 with the third mixing part 423, and be disposed at one side (right side in FIG. 5) of the confluence part 410. The fourth mixing part 424 and the fifth mixing part 425 may be arranged so as to be opposite to the second mixing part 422 with respect to the confluence part 410. Herein, the first to third mixing parts 421, 422, 423 may be arranged at the same distance from the confluence part 410.

While passing through the mixing part 420, the fluid can proceed from the first mixing part 421 to the fifth mixing part 425 to be subjected to emulsification.

Specifically, the internal phase fluid which has been mixed with the external phase fluid at the confluence part 410 may become thinner or be broken while passing through the first mixing part 421. Such progress can be repeated while passing through the downstream mixing parts 421, 422, 423, 424, 425, and finally emulsion can be formed in which fluid that has been broken into small pieces remains stably in the external phase fluid.

In the embodiment, the first mixing part 421 is described by way of example as being configured to rotate the entering fluid in one direction (in the embodiment, clockwise based on the drawing) and then rotate it in the other direction (in the embodiment, anticlockwise based on the drawing).

Specifically, the first mixing part 421 may include a first turning path 4211 which guides fluid so as to rotate in one direction, a second turning path 4212 which guides fluid so as to rotate in the other direction, and a direction conversion path 4213 which converts the rotating direction of the fluid between the first turning path 4211 and the second turning path 4212.

By this first mixing part 421, the internal phase fluid and the external phase fluid are moved along the first turning path 4211 and rotated in one direction, and the rotating direction is converted in the direction conversion path 4213 to be rotated in the other direction, so that vortices can be effectively generated. By the fluid force of the external phase fluid by vortices generated as described above, the internal phase fluid can be broken to be emulsified and mixed.

Further, the first mixing part 421 may include a vortex prompting path 4214 for prompting formation of vortices at upstream of the first turning path 4211 or downstream of the second turning path 4212. The vortex prompting path 4214 may be understood as imparting irregularity to fluid by turning the fluid which is flowing straightly, or by making the fluid, which is turning, flow straightly. Inclusion of such vortex prompting path 4214 can lead to the prompted formation of vortices and the easy generation of emulsion particles in the first mixing part 421. The second mixing part 422 to the fifth mixing part 424 may be formed with the same shape as that of the first mixing part, and the detailed description thereof will be omitted. FIG. 7 is a conceptual diagram for designing a vortex promoting path 4214.

Referring to FIG. 7, each end point of large semicircular lines, which can be formed by an imaginary straight line horizontally passing through the center of the mixing part 421, 422, 423, 424, 425, is connected to a curve. In this case, a length difference indicated by 'd' takes place. So, in order to remove such difference, the vortex prompting path 4214 is further formed, which in turn can lead to an effective utilization of space in the plate 400 of the channel unit.

Further, in the embodiment, the mixing parts 421, 422, 423, 424, 425 are described by way of example as being five in number on the channel unit 40, but the number and arrangement of the mixing parts do not limit the technical idea of the invention.

As described above, the vortices generated in the mixing parts 421, 422, 423, 424, 425 enable the internal phase fluid to be broken by the external phase fluid, thus forming emulsion particles. By continuously disposing these mixing parts 421, 422, 423, 424, 425, continuous emulsification can take place, which enables emulsion to be formed to such a level as to be suitably used as cosmetic even when the internal phase fluid and the external phase fluid do not contain any surfactant.

Further, the mixing section 420 may be disposed around the confluence part 410 and outside the injection holes 402, 404, 406, 408. This mixing section 420 can make fluid move along a longer path. That is, even when the surface area of the plate 400 is small, the mixing section 420 can be disposed such that the total surface area of the plate 400 can be utilized efficiently. For example, the length of the mixing section 420 may be greater than that of circumference of the plate 400.

Further, the microfluidic channel disposed inside the plate 400 may be spaced away from the outermost edge of the plate 400 by 5 mm or more. In this case, it is possible to more perfectly prevent leakage of emulsion caused by pressure of the microfluidic channel inside the plate 400.

Further, a minimum gap between microfluidic channels inside the plate 400 may be 1 mm or more. For example, the gap between adjacent microfluidic channels may be 1 mm or 2 mm.

The particle size adjusting part 430 is disposed at downstream of the mixing section 420. The particle size adjusting part 430 serves as forming fluid (emulsion) of uniform size, even though the fluid has been mixed at the mixing section 420 to have non-uniform sizes. The emulsion particles produced at the mixing parts 421, 422, 423, 424, 425 may have irregular sizes due to vortices which exhibit irregular movements, but their sizes can become uniform by means of the particle size adjusting part 430. Thereby, the emulsion which is finally prepared by the channel unit 40 can have a good quality and improved feeling of use.

The particle size adjusting part 430 may include a converging portion 431 in which the width W1 of a mixing flow path 426 of the mixing section 420 decreases, a convergence maintaining portion 432 which has a width W2 less than width W1 of the mixing flow path 426, a diverging portion 433 in which the width W2 of the convergence maintaining portion 432 increases, and a divergence maintaining portion 434 which has a width W3 greater than the width W1 of the mixing flow path 426.

Herein, a mean size of emulsion particles can be varied according to the width W2 of the convergence maintaining portion 432. That is, the smaller the width W2 of the convergence maintaining portion 432 is, the smaller the formed emulsion particles are. This particle size adjusting part 430 may be understood as being an orifice, and according to an embodiment, the converging portion 431 and the diverging portion 433 may be omitted.

Further, the mean size of emulsion particles may be adjusted by viscosity of fluid stored in each container 210, 220, 230, 240, cross sectional area of a channel, length of a channel, the width W2 of the particle size adjusting part 430 or the like.

Further, the width W2 of the convergence maintaining portion 432 of the particle size adjusting part 430 may be provided variously according to the size of emulsion particle to be set. For example, the width W2 of the convergence maintaining portion 432 of the particle size adjusting part 430 may be 0.1 mm to 0.5 mm.

Meanwhile, at downstream of the particle size adjusting part 430, there may be provided a discharging hole 455 through which emulsion is discharged from the channel unit 40.

A discharging part 456 which finally supplies emulsion to a user may be directly connected to the discharging hole 455. In the embodiment, the discharging part 456 may be directly connected to a lower side of the discharging hole 455, and for this, a portion of the plate constituting the channel unit 40 may be exposed to the outside.

The discharging part 456 may has 80 to 110 degrees with the microfluidic channel formed inside of the plate 400. For example, the discharging part 456 may has 90 degrees with the microfluidic channel formed in the plate. In this case, the movement direction of emulsion generated in the microfluidic channel formed inside the plate 400 may be changed abruptly when the emulsion moves from the discharging hole 455 to the discharging part 456. Therefore, flow speed of the emulsion moving from the microfluidic channel to the discharging part 456 can be decreased.

Further, distance between the discharging part 456 and the storing part 212 may correspond to ½ to ¼ size of a user's palm. For example, distance from the discharging part 456 to one side of the storing part 212 may be 10 mm to 70 mm. By having such distance, the user can receive the emulsion discharged from the lower side of the discharging part 456 and use it.

Further, length of the particle size adjusting part 430 may be correspondingly 10 mm to 70 mm.

Meanwhile, in the embodiment, the flow paths (microfluidic channels) formed in the channel unit 40 may substantially form a single layer path. The single layer path may be understood as a path in which height difference of flow paths is not involved in mixing and emulsification of each fluid or emulsification of the mixed fluid during the mixing and emulsification of fluid. The single layer path may correspond to the confluence part 410, the mixing section 420, the particle size adjusting part 430 or the like, which are realized on the single flat plate as in the embodiment. According to an embodiment, the plate constituting the channel unit 40 may be provided in plural, and a portion of flow path may be separated to be disposed on a different plate. Even in this case, each portion where mixing and emulsification of fluid take place may be realized on the same plate, and in general, may serve as a single layer path. For example, two plates may be stacked in an up and down direction, the confluence part 410 and the first to third mixing part 423 of the mixing section 420 may be formed in the lower layer pate, while the fourth mixing part 424, the particle size adjusting part 430 and the discharging hole 455 may be formed in the upper layer plate. However, in general they may form a series of flow paths, and the height difference may be prevented from being involved in the mixing and emulsification of fluid. In this case, although process unit prices may increase, planar surface area of the plates may be decreased, and thus the apparatus can be advantageously realized with a smaller size when mixing device and emulsifying device should be formed in a restricted space.

In the embodiment of the invention, the channel unit 40 and fluid (internal phase fluid and external phase fluid) may be provided such that Reynolds number Re is equal to or greater than 1, and preferably is equal to or greater than 10.

According to an embodiment, the internal phase fluid and the external phase fluid may have various ranges of viscosity. According to this, pressure which the channel unit 40 can endure may be determined, and for example, the channel unit 40 may be provided such that it can endure pressure of fluid having viscosity of 8000 cps.

Further, operation of the apparatus 1 for manufacturing cosmetic using instantaneous emulsification according to an embodiment of the invention will be described as below.

When a user exerts pressure to the lid 110 of the housing 10 or the plate 400 in which the channel unit 40 is formed, the plate 400 presses the operative unit 30 of each container 20 to introduce into the channel unit 40 the solution contained in each container 20.

The internal phase fluid, the external phase fluid and the functional fluid, which is selectively provided, have been introduced into the channel unit 40, and meet and mixed with each other at the confluence part 410. After that, the fluid which has been subjected to commencement of the mixing and emulsification at the confluence part 410 passes though the mixing section 420 while emulsification is performed and emulsification particles are mixed.

The fluid which has been mixed in the mixing section 420 passes through the particle size adjusting part 430 to make emulsion particles uniform. After that, the fluid is discharged to the outside through the discharging hole 455, which is the final path of the channel unit 40.

Further, in the embodiment, oil and water are described by way of example as being an internal phase fluid and an external phase fluid, but they are described as representative example of a hydrophobic fluid and a hydrophilic fluid, and any hydrophobic fluid and any hydrophilic fluid, which can form emulsion, may be used as an internal phase fluid and an external phase fluid.

Hereinafter, operation and effect of the apparatus 1 for manufacturing cosmetic using instantaneous emulsification as described above will be described.

FIG. 6 is a micrograph showing an emulsion particle of an emulsion composition manufactured using the apparatus for manufacturing cosmetic using instantaneous emulsification of FIG. 1.

Specifically, FIG. 6 is an experimental example of emulsion, which was generated by the apparatus 1 for manufacturing cosmetic using instantaneous emulsification according to the embodiment by using the first container 210 which stores an oil-based fluid that contains no surfactant, as oil that contains coloring matter in a weight ratio of 0.4%, and the second, third and fourth containers 220, 230, 240 which store water-based fluid that contains no surfactant.

Referring to FIG. 6, it can be confirmed that oil particles having a diameter of 1 mm to 2 mm were generated in a water-based fluid without any surfactant (O/W emulsion). As described above, according to an embodiment, the internal phase fluid and the external phase fluid can be emulsified by the channel unit 40 to generate emulsion without adding surfactant.

Further, since the mixing section 420 is arranged so as to efficiently utilize the total area of the plate 400, while making the length of the mixing section 420 longer, sufficient emulsification can be achieved even in a small-sized apparatus.

Further, by providing the particle size adjusting part 430 at the downstream of the mixing section 420, sizes of emulsion particles, which are discharged, can be made uniform and small, thus improving feeling of use.

Further, by using microfluidic channel in the channel unit 40, shapes of channels inside the narrow plate 400 can be variously changed, so that contact surface area between two phases (internal phase fluid and external phase fluid) can become larger, or contact time can be increased, thus facilitating the emulsification.

Further, the governing force of the surface tension in the channel unit 40 can become much greater, so that interphases of emulsion particles can be strong.

Further, in instantaneous emulsification system which employs the microfluidic channel of the channel unit 40, the time which it takes to form emulsion particles and actually use emulsion may be within a few seconds, and thus sufficient formulation stability can be achieved with a small amount of thickener or without thickener.

Further, an apparatus for manufacturing cosmetic using instantaneous emulsification according to an embodiment of the invention can form emulsion particles without surfactant by a user pressing a pump, and the manufactured formulation can reduce stimulus and risk of raw material precipitation caused by surfactant, and improve stickiness of surfactant.

Further, the plurality of containers 20 according to an embodiment of the invention are detachable to the housing 10, and the container 20 which contains fluid that a user want can be coupled to the housing 10 for use. That is, according to the number of the containers 20 and the kind of fluid contained in the container 20, the type of emulsion formed in the channel unit 40, i.e., O/W emulsion or W/O emulsion, can be determined.

Further, according to an embodiment of the invention, raw material stored in the container 20 can be used by being formed into a dosage in the channel unit 40, and thus customized cosmetic can be provided, which is capable of responding instantly.

Further, formulation of effective ingredient, feeling of use and content ratio are can be adjusted according to the kind of fluid contained in the container 20, and ratio of fluids discharged to the channel unit 40, and thus it is possible to manufacture customized cosmetics suitable for personal preference.

Further, by employing the independent pumping part 214, 224, 234, 244 to each container 210, 220, 230, 240, the amount (ratio of raw materials of cosmetic) of fluid discharged to the channel unit 40 according to the number of the containers 20 can be adjusted.

Hereinafter, an apparatus 1' for manufacturing cosmetic using instantaneous emulsification according to another embodiment of the invention will be described with reference to FIGS. 8 to 12.

FIG. 8 is a schematic perspective view showing a configuration of an apparatus for manufacturing cosmetic using instantaneous emulsification according to another embodiment of the invention, FIG. 9 is an exploded perspective view of FIG. 8, FIG. 10 is a perspective view showing a channel unit of FIG. 8, FIG. 11 is a diagram showing a path of a channel unit of FIG. 10, through which a fluid flows.

Referring to FIGS. 8 to 11, an apparatus 1' for manufacturing cosmetic using instantaneous emulsification according to an embodiment of the invention may generate and provide cosmetic material at the moment when a user wants.

The apparatus 1' for manufacturing cosmetic using instantaneous emulsification according to another embodiment of the invention may include a housing 10' which forms its outer appearance, a first container 210' which is provided inside the housing 10' and stores acid fluid that forms external phase fluid, a second container 220' which is provided inside the housing 10' and stores base fluid that forms external phase fluid, and a third container 230' which is provided inside the housing 10' and stores internal phase fluid. Further, the housing 10' may include a discharging part 456' which discharges an instantly emulsified emulsion to the outside of the housing. Herein, the discharging part 456' may be provided at a lid 110'.

In the embodiment of the invention, the external phase fluid is described by way of example as being a water-based raw material of cosmetic, and the internal phase fluid as being oil. However, the technical idea of the invention is not limited to this, and the external phase fluid may be oil, and the internal phase fluid may be a water-based raw material of cosmetic.

Further, the apparatus 1' for manufacturing cosmetic using instantaneous emulsification according to another embodiment of the invention may include a channel unit 40' connected to the first, second and third container 210', 220', 230'.

Further, the apparatus 1' for manufacturing cosmetic using instantaneous emulsification according to another embodiment of the invention may basically have the first, second and third container 210', 220', 230', and the channel unit 40' corresponding to them. That is, the fourth container 240' and the channel flow path (functional fluid flow path 116) along which fluid coming from the fourth container 240' flows may be selectively provided.

Hereinafter, the first container 210' is described as containing acid fluid which forms external phase fluid; the second container 220' as containing base fluid which forms external phase fluid; the third container 230 as containing internal phase fluid; and the fourth container 240' as containing functional fluid. But, fluid contained in each container is not limited to this. Herein, the fourth container 240' and the fluid contained in fourth container 240' may be selectively provided, and the fourth container 240' and the functional fluid may be omitted.

In other words, the emulsion according to the embodiment may be provided by mixing acid fluid forming external phase fluid, base fluid forming external phase fluid, and internal phase fluid, while excluding functional fluid.

In the embodiment, the acid fluid may be fluid whose pH is less than 5. Preferably, pH may be less than 3. The base fluid may be fluid whose pH is greater than 9. Preferably, pH may be greater than 10. Within these pH ranges, microorganism cannot grow, and thus it is unnecessary to add preservative for a long term preservation of cosmetic raw materials.

The functional raw material may be understood as a raw material which is included in cosmetic components for functional improvement, and particularly, a raw material which is legally approved with respect to functions. Further, the functional fluid may be understood as meaning a fluid in which a functional raw material is dissolved or included.

Further, the functional raw material of the invention may have pH less than 5, and preferably, pH less than 3. Further, the functional raw material may have pH greater than 9, and preferably, pH greater than 10. By setting pH ranges like these, the functional fluid may be in a range where microorganism rarely exists or does not exist, and thus it is possible to provide cosmetic which contains no preservative.

Further, functional raw material may contain 20% or more ethanol instead of above-mentioned pH range. In this case, similarly a region where microorganism rarely exists or does not exist may be provided.

Further, according to the apparatus 1' for manufacturing cosmetic using instantaneous emulsification of the embodiment, when an upper portion of the housing 10' or the plate 400' in which the channel unit 40' is formed is pressed in an up and down direction, fluid contained in each container 210', 220', 230', 240' is discharged to the channel unit 40', and then the fluids are mixed in the channel unit 40' and discharged to the outside of the channel unit 40'.

Further, according to an embodiment of the invention, one of two containers may store acid solution, and the other container may store base solution, and these solutions may be mixed in the channel unit 40' and discharged to the outside of the housing 10'. Specifically, one container may store solution, which is a cosmetic raw material, such that its pH is less than 3, and the other container may store solution, which is a cosmetic raw material, such that its pH is greater than 10. In this case, a region where microorganism rarely exists or does not exist can be provided, and thus it is possible to provide cosmetic which contains no preservative.

The housing 10' may be formed in a predetermined shape which accommodates the first, second, third and fourth containers 210', 220', 230', 240', and is described by way of example as being formed in a cylindrical shape in the embodiment. However, the technical idea of the invention is not limited to this.

Further, the housing 10' may include a lid 110' which covers the upper portion of the housing 10' and accommodate the plate 400'. Further, an upper portion of the lid 110' may include an opening 114', so that a user can see a portion or the whole of the channel unit 40'. For example, the opening 114' may be a circular or rectangular hole. However, there is no limit in its shape.

Further, the housing 10' may include a supporting part 130' for substituting a cartridge.

The supporting part 130' may be removably coupled with the housing 10', and may support lower parts of the containers 210', 220', 230', 240' when being coupled therewith, so that the containers 210', 220', 230', 240' can be stably stored in the housing 10'. In the embodiment, the supporting part 130', which constitutes a bottom part of the cylindrical housing 10', is described by way of example as being provided for substitution of the containers 210', 220', 230', 240', but the shape and location of the supporting part 130' are limited to this.

Further, the supporting part 130' may include a plurality of grooves 132*a*', 132*b*', 132*c*', 132*d*' for fixing each containers 210', 220', 230', 240' which have been installed in the housing 10'.

The first, second, third and fourth containers 210', 220', 230', 240' may be accommodated inside the housing 10', attached to the outside of the housing 10' or provided in such a manner that they can be substituted.

According to the embodiment, when each container 210', 220', 230', 240' is installed in the housing 10', the first, second, third and fourth containers 210', 220', 230', 240' can be fixed by the grooves 132*a*', 132*b*', 132*c*', 132*d*' formed on the supporting part 130' of the housing 10'. For example, when each container 210', 220', 230', 240' is accommodated in the housing 10', and the supporting part 130' of the housing 10' is mounted to the housing 10', the first container 210' may be fitted to the first groove 132*a*'; the second container 220' to the second groove 132*b*'; the third container 230' to the third groove 132*c*'; and the fourth container 240' to the fourth groove 132*c*'.

Further, each container 210', 220', 230', 240' may be provided as a cartridge which is separably and removably coupled to the housing 10'. In this case, there is an advantage that a user can select a functional material, an external phase fluid, cosmetic pH or the like which are suitable for the user's skin. Further, by substituting a raw material which has been completely used for a new raw material, the apparatus 1' for manufacturing cosmetic using instantaneous emulsification can be used continuously. A portion of the housing 10' may be formed with a transparent material, so that a user can check the remainder quantity of each container 210', 220', 230', 240'.

The first container 210' may include a storing part 212' which stores fluid, a discharging hole 213 through which fluid is discharged, and a pumping part 214' which generates pressure for discharging the fluid. In this case, by installing an elastic member 215' between the storing part 212' and the pumping part 214', the pumping part 214' can be returned to its original position.

Further, like the first container 210', the second, third or fourth container 220', 230', 240' may include a storing part 222, 232, 242, a discharging hole 223, 233, 243, a pumping part 224, 234, 244, and an elastic member 225, 235, 245.

Further, the plate 400' in which the channel unit 40' to be described later is formed may press the pumping part provided at the upper portion of each container, so that the fluid stored in the storing part of each container can be discharged to the channel unit 40'. Specifically, acid fluid is discharged from the first discharging hole 213 of the first container 210' to an acid fluid injection hole 411 to be described later; base fluid is discharged from the second discharging hole 223 of the second container 220' to a base fluid injection hole 412 to be described later; internal phase fluid is discharged from the third discharging hole 233 of the third container 230' to an internal phase fluid injection hole 402' to be described later; and functional fluid is discharged from the fourth discharging hole 243 of the four container 240' to a functional fluid injection hole 408' to be described later.

Further, the pumping part 214', 224, 234, 244 of each container 210', 220', 230', 240' may have a shape of a truncated cone, and each fluid injection hole 411, 412, 402', 408' may be formed in the plate 400' in a shape corresponding to this. That is, when the pumping part 214', 224, 234, 244 is coupled to the plate 400', the pumping part 214', 224, 234, 244 can be fitted to the plate 400' without any gap therebetween. However, the shape of the pumping part 214', 224, 234, 244 is not limited to this, but may have various shapes, such as a circular column shape, a rectangular parallelepiped shape and the like.

The embodiment of the invention is described by way of example as fluid stored in the storing part 212', 222, 232, 242 of each container being discharged when the plate 400' in which the channel unit 40' is formed applies pressure to the pumping part, but separate pump may be included. For example, a separate pump may be provided in the housing 10', such that acid fluid, base fluid, functional fluid, which is selectively provided, and internal phase fluid can be discharged to the discharging part 456' via the channel unit 40'.

The channel unit 40' may be formed on the plate 400'. FIG. 10 illustrates an embodiment in which each channel 41, 42 is formed in the single plate 400', but a plurality of plates in which channels 41, 42 have been formed may be stacked in an up and down direction.

The channel unit 40" may include a first channel 41 which is connected with the first, second and fourth containers 210', 220' and 240', and a second channel 42 where fluid supplied from the first channel 41 and internal phase fluid supplied from the third container 230' are mixed with each other. Herein, the first channel 41 and the second channel 42 may be understood as microfluidic channels.

The first and second channels 41, 42 may be understood as a predetermined flow path along which fluid entered into the channel can move, and may be formed in the plate 400'. However, provision method of the first and second channels 41, 42 is not limited to this. For example, the first and second channels 41, 42 may be formed by assembling a plurality of parts including flow paths.

Further, the plate 400' may be transparent, so that fluids can be seen flowing in the first and second channels 41, 42.

The first channel 41 may generate a neutralized internal phase fluid by mixing acid fluid which is supplied from the first container 210' to form external phase fluid, with base fluid which is supplied from the second container 220' to form external phase fluid.

Herein, pH of the neutralized internal phase fluid may be understood as being 4 to 8. Further, pH of final emulsion after the mixing of the neutralized internal phase fluid with internal phase fluid supplied from the second channel 42 may be between 4 and 8.

Further, pH of functional fluid, which is selectively supplied, may be between 4 and 8 like pH of the final emulsion.

The first channel 41 may include a first confluence part 415 where acid fluid and base fluid meet with each other, a mixing part 421' which forms neutralized external phase fluid by advancing the acid fluid and base fluid together that have met with each other in the first confluence part 415, and a connecting part 428 which provides the neutralized fluid generated in the mixing part 421' to the second channel 42. That is, the first channel 41 may be understood as a region from a point in which the acid fluid and the base fluid are introduced, to the connecting part 428.

Further, the first channel 41 may include the acid fluid injection hole 411 which is connected the first container 210', the base fluid injection hole 412 which is connected to the second container 220', the functional fluid injection hole 408' which is connected to the fourth container 240', the first confluence part 415 in which the acid fluid coming from the acid fluid injection hole 411, the base fluid coming from the base fluid injection hole 412, and the functional fluid coming from the functional fluid injection hole 408' meet with each other, and the mixing part 421' which generates the mixed fluid by advancing the acid fluid, the base fluid and the functional fluid together that have met with each other in the first confluence part 415. Herein, by forming four or more mixing parts 421', it is possible to mix each fluid more effectively.

Further, the first channel 41 may include an acid fluid flow path 414 which connects between the acid fluid injection hole 411 and the first confluence part 415, a base fluid flow path 418 which connects between the base fluid injection hole 412 and the first confluence part 415, and a functional fluid flow path 416 which connects between the functional fluid injection hole 408' and the first confluence part 415.

The mixing part 421' may be a flow path which can form vortices in flow by converting a proceeding direction of fluid. For this, the mixing part 421' may include a bent part, a curved part, a turning part and the like which can convert the proceeding direction of fluid.

Particularly, in a case where the mixing part 421' is formed so as to make fluid turn one direction or both directions, the fluid is subjected to centrifugal force while vortices are being formed in the fluid, and thus the fluid can be sufficiently mixed while passing through the mixing part 421'.

In the embodiment, the mixing part 421' is described by way of example as being configured to rotate the entering fluid in one direction (anticlockwise based on the drawing) and then rotate it in the other direction (clockwise based on the drawing). Specifically, the mixing part 421' may include a first turning path 4211' which guides fluid so as to rotate in one direction, a second turning path 4212' which guides fluid so as to rotate in the other direction, and a direction conversion path 4213' which converts the rotating direction of the fluid between the first turning path 4211' and the second turning path 4212'.

By this mixing part 421', the acid fluid, the base fluid and the functional fluid are moved along the first turning path 4211' and rotated in one direction, and the rotating direction is converted in the direction conversion path 4213' to be rotated in the other direction while being mixed, so that vortices can be effectively generated. Further, in the embodiment, the mixing part 421' is described by way of example as being four in number which are continuously arranged on the channel unit 41, but the number and arrangement of the mixing part 421' do not limit the technical idea of the invention.

Meanwhile, in the embodiment, the mixing part 421' is described by way of example as prompting the mixing of fluids by converting their proceeding directions, but the method for mixing fluid is not limited to this. There may be provided various methods which can stir fluid in a microfluidic channel, such as a method which increases the contact surface area, a method which applies electric field, and a method which uses sound waves.

In the above-described embodiment, the acid fluid, the base fluid and the functional fluid are all provided, but the functional fluid may be selectively input. In this case, the functional fluid injection hole 408' and the functional fluid flow path 416 may be excluded.

Further, in a case where the functional fluid is provided, the fourth container which can store functional fluid may be one or more in number. For example, the fourth container may be three in number, and each fourth container may be provided with functional fluid suitable for user's preference.

The acid fluid and the base fluid may be sufficiently mixed with each other while passing through the mixing part 421', and such mixed fluids may be referred to as neutralized fluid in the embodiment. Further, the acid fluid and the base fluid form external phase fluid, and may be understood as neutralized external phase fluid.

Further, the acid fluid and the base fluid may be water-based cosmetic fluid as external phase fluid. The water-based cosmetic is intrinsically an environment in which microorganism can grow easily. However, such water-based cosmetic raw material can become an environment where microorganism is difficult to grow while changing pH to an acid or base condition. Therefore, in the embodiment, cosmetic to which preservative is not added can be presented.

Further, in a case where functional fluid is additionally provided, the solution in which acid fluid, base fluid and the functional fluid are mixed may be understood as neutralized solution in respect of pH. Such solution may be referred to as neutralized mixture fluid. In the embodiment of the invention, pH of the neutralized solution may be understood as being between 4 and 8.

The second channel 42 generates emulsion, which is an emulsified material, by stirring internal phase fluid supplied from the third container 230' and the neutralized external phase fluid supplied from the first channel 41.

Herein, the neutralized fluid including external phase fluid, and internal phase fluid can be emulsified to make emulsion in a very short time when passing through the second channel 42. That is, the neutralized fluid and internal phase fluid can be instantly emulsified. At this time, the neutralized fluid may be instantly emulsified in the second channel 42, and internal phase fluid may be dispersed in a particle state between external phase fluid and functional fluid.

The second channel 42 may include an internal phase fluid injection hole 402' connected to the third container 230', a second confluence part 427 in which the neutralized external phase fluid supplied from the connecting part 428 of the first channel 41 meet with internal phase fluid, an emulsification part 444 which generates emulsion by emulsifying the neutralized external phase fluid and the internal phase fluid that have met with each other at the second confluence part 427, and an outer discharging hole 129 which discharges to the outside the emulsion generated by the emulsification part 444.

Herein, the path from the internal phase fluid injection hole 402' to the second confluence part 427 may be formed in various shapes, such as curve, straight line or the like.

The emulsification part 444 functions to cause internal phase fluid to break neutralized fluid flow, and internal phase fluid to be dispersed into neutralized fluid in a particle state. The emulsification part 444 may be disposed at a rear side of the second confluence part 427. The emulsification part 444 may be an orifice whose width is narrowed in a proceeding direction of fluid. The emulsification part 444 may be an orifice which is formed so as to have a width smaller than the internal phase fluid movement path 446 and a discharging path 442.

In this time, the outer discharging hole 129 from the discharging path 442 may be formed on an extension part 460 of the plate 400'.

Herein, the extension part 460 may be understood as a portion extending to a side of the plate 400' on which the channel unit 40' is formed. This portion may be understood as a portion which does not overlap the housing 10' when the housing 10' is viewed in an up and down direction.

The internal phase fluid exerts shearing force to mixture fluid in a resultant force direction of a narrowing direction (defined as a diagonal direction converging to a center side) of orifice inner side (defined as a vertical direction) and a flowing direction of fluid (defined as a horizontal direction) while passing through an orifice having a relatively small width. Due to this force and a geometrical shape of a corner portion of the orifice entrance, flow stream of the mixture fluid is broken into a particle form. When two fluids which are not mixed pass through an orifice with unstable interfaces, capillary instability increases, and a channel having an orifice can break flow of mixture fluid with relatively small energy when compared to a channel having no orifice. The broken neutralized external phase fluid becomes a spherical form to maintain a stable state, and internal phase fluid is dispersed into the neutralized external phase fluid.

An emulsifying manner using an orifice as in the embodiment may be referred to as flow-focusing method emulsification. By disposing an orifice at a confluence part while allowing fluids different in a phase from each other to flow in the same direction, internal phase fluid can break stream of external phase fluid (flow-focusing method). By using such orifice, flow of internal phase fluid is changed to a diagonal direction of orifice inner side, and can exert stronger shearing force to neutralized external phase fluid, which leads to easy formation of emulsion particles and at the same time to uniform size of emulsion particles.

Other than this, various embodiments may be employed as the emulsification part 444. For example, a method which emulsifies while moving fluids different in phase from each other in the same direction (Co-Flow method), a method which emulsifies while moving fluids different in phase from each other so as to cross each other (Cross-Flow method), a method which forms emulsion particles at a confluence part by increasing or decreasing an aspect ratio of entrance mouths to the confluence part of external and internal phase fluids (Step Emulsification method), and a method which forms emulsion particles by causing internal phase fluid or two phase mixture fluid to pass through holes of membrane (Membrane Emulsification method) may be employed.

Further, the emulsification part 444 may use a driving force source. For example, a channel of a method which forms emulsion particles using one or more of electric field (electrical control), magnetic field (magnetic control), centrifugal force (centrifugal control), laser (optical control), a vibrator (vibration control) and piezoelectric material (piezoelectric control) may be used.

Further, the emulsification part 444 may form emulsion particles by changing interfacial tension and viscosity of fluid. For example, electrorheological (ER) or magnetorheological (MR) fluids, Photo-sensitive fluids may be employed.

Emulsion formed in the emulsification part 444 may become stable while passing though the discharging path 442. Herein, inner wall of the discharging path 442 may be provided so as to have properties corresponding to hydrophilicity of external phase fluid.

In this case, external phase fluid forming external phase of emulsion will be attracted to the inner wall of the discharging path 442, and in contrast to this, internal phase fluid is repelled away from the inner wall of the discharging path 442. Thus, emulsion state can be stably maintained during movement. As in the embodiment of the invention, if internal phase fluid is oil, the inner wall of the discharging path 442 may be coated with film of hydrophilic material.

Herein, material whose contact angle with water is 0 to 50 degrees may be used as hydrophilic material or film.

Conversely, if oil is used as internal phase fluid, the inner wall may be coated with film of hydrophobic material, and material whose contact angle with water is 70 to 120 degrees may be used as hydrophobic material or film.

Further, according to an embodiment, besides the discharging path 442, other components of the emulsification part 444 and the second channel 42 may be formed so as to have properties corresponding to hydrophilicity of external phase fluid.

In prior art, since interfacial tension of external and internal phase fluids is so high as not to be mixed with each other easily, it is quite difficult to form and maintain emulsion particles without using large amount of surfactant (1-5%). However, according to the embodiment, since surface force at the second channel 42 which has very small characteristic length (equal to or less than millimeter) affects fluid more than body force, emulsification can be advantageously rapidly achieved without using surfactant or with only minimal addition thereof. Further, the principle that one of two fluids which are not easily mixed with each other breaks flow of the other fluid to form emulsion particles contributes to reduction of surfactant.

Further, according to an embodiment, acid solution and base solution have different colors, and when the acid solution and the base solution are mixed with each other, their colors change to a different color. Thus, a user can see color of safe cosmetic which appears as neutralized solution through the transparent plate 400'. For example, if acid fluid which is contained in the first container 210' and forms external phase fluid is red, and base fluid which is contained in the second container 220' and forms external phase fluid is blue, neutralized fluid in which the acid fluid and the base fluid are mixed may be yellow. Therefore, by seeing color of fluid flowing through a flow path of the channel unit 40', a user can recognize that safe cosmetic is provided.

Hereinafter, operation and effect of the apparatus for manufacturing cosmetic using instantaneous emulsification as described above will be described.

According to an embodiment of the invention, one container stores water-based solution such that its pH is less than 3, and another container stores water-based solution such that its pH is greater than 10. Thus, a region where microorganism rarely exists or does not exist can be provided, and it is possible to provide cosmetic which uses no preservative.

According to an embodiment of the invention, acid solution, base solution and neutralized solution in which they are mixed are realized so as to have different colors, and thus a user can confirm only from colors that cosmetic to be used by the user has a pH within a stable range.

Further, 0.05% citric acid is input to the first container 210', and 0.08% Tris aminoultra PC is added to the second container 220', so that their pHs are set to 3 and 10, respectively. 25% Finsolv TN-O is input to the third container 230' and 2% EGCG (epigallocatechin-3-gallate) as a functional material is mixed with 20% or more ethanol or polyol(BG) to become functional raw material in the fourth container 240'. Then, experiments were performed to check whether microorganism growth environment and suitable pH were obtained. According to results of the experiments, due to the effect of oil stored in the third container 230', ethanol stored in the fourth container 240', and pH of the solutions stored in the first and second container 210', 220', microorganism could not grow in each container 210', 220', 230', 240'. Therefore, final pH of emulsion which has been stirred through the channel unit 40' was 6.7, and thus it was confirmed to be in a state where it can be used to skin safely.

According to an embodiment of the invention, by forming four or more mixing parts 421' to form vortices, mixing of each fluid can be done more effectively, and thus it is possible to provide cosmetic in which surfactant use is reduced.

According to an embodiment of the invention, each container may be provided as a cartridge which is separably and replaceably coupled to the housing. In this case, there is an advantage that a user can select a functional material or cosmetic pH which is suitable for the user's skin.

Further, when a user presses the upper portion of the housing 10', cosmetic is instantly prepared and provided. Therefore, fresh cosmetic can be used instead of cosmetics that have been manufactured in mass production and sold by cosmetic manufacturer.

Further, it is possible to minimize use of surfactant or thickener considering long term stability of cosmetic, and thus a use can use cosmetic in which content of additive material is minimized.

Further, operation of the apparatus for manufacturing cosmetic using instantaneous emulsification according to an embodiment of the invention will be described as below. Hereinafter, the container is described by way of example as being four in number, but it may be three in number by excluding a container in which functional solution is contained.

When a user exerts pressure to the upper portion of the housing 10' or the plate 400' in which the channel unit 40' is formed, the plate 400' presses the pumping part 214', 224, 234, 244 of each container 210', 220', 230', 240' to introduce into the channel unit 40' solutions contained in the storing parts 212',222,232,242.

The acid fluid, base fluid and functional fluid which have been introduced into the first channel 41 meet with each other in the first mixing part 415. After that, three fluids pass through the mixing part 421' and mixed to become neutralized fluid. Due to vortices generated when passing through the mixing part 421', the acid fluid, the base fluid and the functional fluid are mixed with each other more smoothly.

Three fluids which have been mixed in the first channel 41 pass through the connecting part 428, and meet at the second confluence part 427 with internal phase fluid which has been introduced into the internal phase fluid injection hole 402', and the external phase fluid passes through the orifice which is provided as the emulsification part 444 to be broken into a particle form, while the internal phase fluid is dispersed into the external phase fluid.

After that, emulsion is discharged to the outside through the outer discharging hole 129 which is a final path of the second channel 42 and the discharging part 456' formed in the housing 10'.

Meanwhile, in above-described embodiments, oil is used as internal phase fluid, and water is used as external phase fluid, thus generating O/W emulsion, but it is also possible that water is used as internal phase fluid, and oil is used as external phase fluid, thus generating O/W emulsion.

Further, in the embodiment, oil and water are described by way of example as being an internal phase fluid and an external phase fluid, but they are described as representative example of a hydrophobic fluid and a hydrophilic fluid, and any hydrophobic fluid and any hydrophilic fluid, which can form emulsion, may be used as an internal phase fluid and an external phase fluid.

Hereinafter, an apparatus for manufacturing cosmetic using instantaneous emulsification according to another embodiment of the invention will be described with reference to FIG. 12. However, the embodiment of FIG. 12 is different from the embodiment of FIGS. 7 to 11 in that the first channel 41 and the second channel 42 are provided on separate plates, and thus such different feature will be mainly described, while reference to the above-described embodiment will be made for the description and reference signs of same parts.

FIG. 12 is a schematic perspective view showing a configuration of the channel unit 40' of an apparatus for manufacturing cosmetic using instantaneous emulsification according to another embodiment of the present invention.

Referring to FIG. 12, the first channel 41 and the second channel 42 may be formed in separate plates. Specifically, the first channel 41 may be formed in the first plate 13, and the second channel 42 may be formed in the second plate 15.

And, a connecting part 119*a* of the first channel 41 and a connecting part 119*b* of the second channel 42 are connected to each other. Specifically, a connecting flow path 60 may be formed between the connecting part 119*a* of the first channel 41 and the connecting part 119*b* of the second channel 42, or the first plate 13 and the second plate 15 may be stacked without the connecting flow path 60.

Further, like the above-described embodiment, the first container 210 may be coupled to the acid fluid injection hole 411'; the second container 220' to the base fluid injection hole 412'; the fourth container 240' to the functional fluid injection hole 408"; and the third container 230' to the internal phase fluid injection hole 402". Herein, in a case where the connecting flow path 60 is formed between the connecting part 119*a* of the first channel 41 and the connecting part 119*b* of the second channel 42, a hole 121*a* through which the third container 230' penetrates is formed in the second plate 400', and a portion of the third container 230' may be formed so as to correspond to this shape.

Further, even though not shown in the drawing, three or more plates may be stacked to form channel unit 40'.

In the embodiment, the first plate 13 and the second plate 15 are stacked from the bottom to the top, but the stacking order of the first plate 13 and the second plate 15 can be changed.

Further, in the embodiment of the invention, the channel unit 40' is covered by the lid 110', but the channel unit 40 and the plates 13, 15 corresponding to this may be provided in a lower portion of the housing 10', and it may be configured such that mixed fluid can be discharged to the discharging part 456' formed in the upper portion of the housing 10'.

Hereinafter, embodiments of above-described apparatus for manufacturing cosmetic using instantaneous emulsification will be listed.

Item 1: An apparatus for manufacturing cosmetic using instantaneous emulsification, the apparatus comprising: a housing which forms an outer appearance; an internal phase container which is replaceably coupled to the housing, and which stores internal phase fluid; an external phase container which is replaceably coupled to the housing, and which stores external phase fluid; a channel unit which generates emulsion by mixing the internal phase fluid provided from the internal phase container and the external phase fluid provided from the external phase container; and an operative unit which provides external force required to form and discharge emulsion at the channel unit by manipulation of a user, wherein the internal phase container and the external phase container have a pumping part which is operated by action of the operative unit, and wherein the operative unit presses the pumping part of the internal phase container and the pumping part of the external phase container at the same time by external force to discharge the internal phase fluid stored in the internal phase container and the external phase fluid stored in the external phase container to the channel unit.

Item 2: The apparatus for manufacturing cosmetic using instantaneous emulsification of Item 1, wherein each of the internal phase container and the external phase container is provided one or more in number, and wherein by one-time operation of the operative unit, total discharging amount of the external phase fluid discharged from the external phase container is greater than total discharging amount of the internal phase fluid discharged from the internal phase container.

Item 3: The apparatus for manufacturing cosmetic using instantaneous emulsification of Items 1 and 2, wherein the internal phase fluid and the external phase fluid exclude surfactant.

Item 4: The apparatus for manufacturing cosmetic using instantaneous emulsification of Items 1 to 3, wherein the channel unit is provided as a continuous single layer path formed in one or more plates, and includes a mixing section which has a plurality of mixing parts with a direction converting path capable of converting a rotational direction of fluid.

Item 5: The apparatus for manufacturing cosmetic using instantaneous emulsification of Items 1 to 4, further comprising a functional container which is replaceably coupled to the housing, and which stores functional fluid, wherein the functional container includes a pumping part which is driven by operation of the operative unit at the same time with the pumping part of the internal phase container and the pumping part of the external phase container, and which discharges the functional fluid to the channel unit.

Item 6: The apparatus for manufacturing cosmetic using instantaneous emulsification of Items 1 to 5, wherein containers provided as the internal phase container and the external phase container have same size and discharging amount, and are replaceably provided to the housing.

Item 7: The apparatus for manufacturing cosmetic using instantaneous emulsification of Items 1 to 6, wherein each of the internal phase container and the external phase container includes: a storing part which stores fluid; a pumping part which is moved by the operative unit to form pressure for discharging the fluid; an elastic member which provides restoring force to the pumping part; and a discharging end portion for discharging fluid stored in the storing part to the channel unit.

Item 8: The apparatus for manufacturing cosmetic using instantaneous emulsification of Items 1 to 7, wherein inside of the storing part is provided with a chamber having a space whose volume is changed according to movement of the pumping part so as to generate pressure for discharging fluid.

Item 9: The apparatus for manufacturing cosmetic using instantaneous emulsification of Items 1 to 8, wherein the operative unit includes a sliding surface which slides along an inner surface of the housing so as to move along the inner surface of the housing by external force.

Item 10: The apparatus for manufacturing cosmetic using instantaneous emulsification of Items 1 to 9, wherein the operative unit includes pressing surfaces which are capable of pressing the pumping parts of the internal phase container and the external phase container at the same time.

Item 11: The apparatus for manufacturing cosmetic using instantaneous emulsification of Items 1 to 10, wherein the operative unit includes a plurality of flow paths which are capable of transferring to the channel unit the internal phase fluid discharged from the internal phase container, and the external phase fluid discharged from the external phase container.

Item 12: The apparatus for manufacturing cosmetic using instantaneous emulsification of Items 1 to 11, wherein the channel unit includes: a confluence part in which the internal phase fluid provided from the internal phase container and the external phase fluid provided from the external phase container are mixed with each other; and a mixing section including a plurality of the mixing parts which are continuously disposed around the confluence part, and which generate emulsion particles by converting proceeding direction of fluid and thus forming vortices in flow.

Item 13: The apparatus for manufacturing cosmetic using instantaneous emulsification of Items 1 to 12, wherein the mixing part includes: a first rotation path for guiding an entering fluid to be rotated in one direction; a second turning path which guides the fluid rotating in one direction to be rotated in another direction; and a direction converting path which changes a rotational direction of fluid between the first turning path and the second turning path.

Item 14: The apparatus for manufacturing cosmetic using instantaneous emulsification of Items 1 to 13, wherein the mixing part which is formed on the channel unit is provided three or more in number.

Item 15: The apparatus for manufacturing cosmetic using instantaneous emulsification of Items 1 to 14, wherein the internal phase container and the external phase container include a cartridge which is separably and replaceably coupled to the housing.

Item 16: An apparatus for manufacturing cosmetic using instantaneous emulsification, including a housing which forms an outer appearance; a discharging part provided in the housing for discharging an instantly emulsified emulsion to the outside of the housing; a first container provided in the housing for storing acid fluid which forms external phase fluid; a second container provided in the housing for storing base fluid which forms external phase fluid; a third container provided in the housing for storing internal phase fluid; and a channel unit provided in the housing for receiving the internal phase fluid, the acid fluid and the base fluid to generate emulsion, wherein the channel unit includes a first channel which generates neutralized external phase fluid by mixing the acid fluid and the base fluid; and a second channel which generates emulsion by mixing the internal phase fluid and the neutralized external phase fluid supplied from the first channel.

Item 17: The apparatus for manufacturing cosmetic using instantaneous emulsification of Item 16, wherein the first channel and the second channel are formed in a single plate.

Item 18: The apparatus for manufacturing cosmetic using instantaneous emulsification of Items 16 and 17, wherein the first channel and the second channel are formed in two plates, respectively, which are staked in an up and down direction.

Item 19: The apparatus for manufacturing cosmetic using instantaneous emulsification of Items 16 to 18, wherein each container is provided as a cartridge which is separably and replaceably coupled to the housing.

Item 20: The apparatus for manufacturing cosmetic using instantaneous emulsification of Items 16 to 19, wherein each cartridge includes a storing part which stores fluid; and a discharging hole through which the fluid is discharged; a pumping part which generates pressure for discharging the fluid, the plate in which the channel unit is formed is provided so as to press the pumping part, and discharges to the channel unit the fluid stored in the storing part.

Item 21: The apparatus for manufacturing cosmetic using instantaneous emulsification of Items 16 to 20, wherein the discharging hole of the cartridge is provided on an upper side of the pumping part, and the channel unit is directly connected to the discharging hole.

Item 22: The apparatus for manufacturing cosmetic using instantaneous emulsification of Items 16 to 21, wherein the plate in which the channel unit is formed presses the pumping part, so that the acid fluid stored in the first container and the base fluid stored in the second container are discharged to the first channel, and the internal phase fluid stored in the third container is discharged to the second channel.

Item 23: The apparatus for manufacturing cosmetic using instantaneous emulsification of Items 16 to 22, wherein the first channel includes a first confluence part in which the acid fluid and the base fluid meet with each other; a mixing part which advances the acid fluid and the base fluid that have met with each other at the first confluence part, and which generates neutralized external phase fluid; a connecting part which provides the neutralized external phase fluid that has been generated in the mixing part to the second channel.

Item 24: The apparatus for manufacturing cosmetic using instantaneous emulsification of Items 16 to 23, wherein the mixing portion is formed to form a vortex in flow by converting a proceeding direction of fluid.

Item 25: The apparatus for manufacturing cosmetic using instantaneous emulsification of Items 16 to 24, wherein the mixing part includes a first turning path which guides an entering fluid to be rotated in one direction; a second turning path which guides the fluid rotating in one direction to be rotated in another direction; and a direction converting path which changes a rotational direction of fluid between the first turning path and the second turning path.

Item 26: The apparatus for manufacturing cosmetic using instantaneous emulsification of Items 16 to 25, wherein the mixing part is provided four or more in number in the first channel.

Item 27: The apparatus for manufacturing cosmetic using instantaneous emulsification of Items 16 to 26, wherein the second channel includes an internal phase fluid injection hole through which the internal phase fluid is introduced; a second confluence part in which the internal phase fluid and the neutralized external phase fluid meet with each other; an emulsification part which generates emulsion by emulsifying the internal phase fluid and the neutralized external phase fluid that have met with each other at the second confluence part; and an outer discharging hole through which the emulsion generated in the emulsification part is discharged to the outside of the channel unit.

Item 28: The apparatus for manufacturing cosmetic using instantaneous emulsification of Items 16 to 27, wherein pH of the acid fluid is equal to or less than 3, pH of the base fluid is equal to or greater than 10, and pH of neutralized external phase fluid which has been formed by the acid fluid and the base fluid meeting with each other is 4 to 8.

Item 29: The apparatus for manufacturing cosmetic using instantaneous emulsification of Items 16 to 27, wherein the acid fluid and the base fluid are water-based cosmetic raw material as external phase fluid, and the internal phase fluid is oil.

Item 30: The apparatus for manufacturing cosmetic using instantaneous emulsification of Items 16 to 29, further including a fourth container which is connected to the first channel to provide functional fluid to the first channel, wherein the fourth container is provided one to three in number.

Item 31: The apparatus for manufacturing cosmetic using instantaneous emulsification of Items 16 to 30, wherein the fourth container is provided as a cartridge which is separably and replaceably coupled to the housing.

Item 32: The apparatus for manufacturing cosmetic using instantaneous emulsification of Items 16 to 31, wherein the first channel includes a functional fluid flow path that connects the first confluence part in which the acid fluid and the base fluid meet with each other to a functional fluid injection hole to which the functional fluid is introduced.

Item 33: The apparatus for manufacturing cosmetic using instantaneous emulsification of Items 16 to 32, wherein a plate in which the channel unit is formed has an extension part which extends from the housing in a side direction, and at least a portion of flow path which provides the emulsion from the second channel to the discharging part is formed in the extension part, and the discharging part provided to the housing is connected to a portion of the extension part, so that the emulsion can be discharged to the outside of the housing by the discharging part.

Item 34: The apparatus for manufacturing cosmetic using instantaneous emulsification of Items 16 to 33, wherein at least a portion of the first channel or the second channel is formed transparently, so that a user can check that the emulsion is moved to the discharging part.

While until now the apparatus 1 for manufacturing cosmetic using instantaneous emulsification according to examples of the disclosure has been described as concrete embodiments, these are just exemplary embodiments, and the present invention should be construed in a broadest scope based on the fundamental technical ideas disclosed herein, rather than being limited to them. By combining or replacing a part or parts of embodiments disclosed herein, the ordinary skilled in the art may carry out a type of form which is not explicitly described herein, and however, it should be noted that it shall not depart from the scope of the present invention. Besides, the ordinary skilled in the art may easily change or modify embodiments disclosed herein based on the disclosure, and however, it is obvious that such change or modification also falls within the scope of the present invention.

NUMERICAL REFERENCE LIST

1: apparatus for manufacturing cosmetic using instantaneous emulsification
10: housing
20: container
30: operative unit
40: channel unit
110: lid
120: main body
130: supporting part
210: first container
220: second container
230: third container
240: fourth container
402: internal phase fluid injection hole
404: first external phase fluid injection hole
406: second external phase fluid injection hole
408: functional fluid injection hole
410: confluence part
420: mixing section
430: particle size adjusting part

What is claimed is:

1. An apparatus for manufacturing cosmetic using instantaneous emulsification, the apparatus comprising:

a housing which forms an outer appearance;

an internal phase container which is replaceably coupled to the housing, and which stores internal phase fluid;

an external phase container which is replaceably coupled to the housing, and which stores external phase fluid;

a channel unit which generates emulsion by mixing the internal phase fluid provided from the internal phase container and the external phase fluid provided from the external phase container; and an operative unit which provides external force required to form and discharge emulsion at the channel unit by manipulation of a user, wherein the internal phase container and the external phase container have a pumping part which is operated by action of the operative unit, wherein the operative unit presses the pumping part of the internal phase container and the pumping part of the external phase container at the same time by external force to discharge the internal phase fluid stored in the internal phase container and the external phase fluid stored in the external phase container to the channel unit, and wherein the channel unit includes:

a confluence part in which the internal phase fluid provided from the internal phase container and the external phase fluid provided from the external phase container are mixed with each other; and a mixing section including a plurality of mixing parts which are continuously disposed around the confluence part, and which generate emulsion particles by converting proceeding direction of fluid and thus forming vortices in flow, wherein the confluence part and the mixing section are provided as a single layer path formed on a single flat plate, and wherein the single layer path is a path in which height difference of the paths is not involved during the mixing of fluid.

2. The apparatus for manufacturing cosmetic using instantaneous emulsification of claim 1, wherein each of the internal phase container and the external phase container is provided one or more in number, and wherein by one-time operation of the operative unit, total discharging amount of the external phase fluid discharged from the external phase container is greater than total discharging amount of the internal phase fluid discharged from the internal phase container.

3. The apparatus for manufacturing cosmetic using instantaneous emulsification of claim 1, wherein the internal phase fluid and the external phase fluid exclude surfactant.

4. The apparatus for manufacturing cosmetic using instantaneous emulsification of claim 1, further comprising a functional container which is replaceably coupled to the housing, and which stores functional fluid, wherein the functional container includes a pumping part which is driven by operation of the operative unit at the same time with the pumping part of the internal phase container and the pumping part of the external phase container, and which discharges the functional fluid to the channel unit.

5. The apparatus for manufacturing cosmetic using instantaneous emulsification of claim 1, wherein containers provided as the internal phase container and the external phase container have same size and discharging amount, and are replaceably provided to the housing.

6. The apparatus for manufacturing cosmetic using instantaneous emulsification of claim 1, wherein each of the internal phase container and the external phase container includes:

a storing part which stores fluid;

a pumping part which is moved by the operative unit to form pressure for discharging the fluid;

an elastic member which provides restoring force to the pumping part; and a discharging end portion for discharging fluid stored in the storing part to the channel unit.

7. The apparatus for manufacturing cosmetic using instantaneous emulsification of claim 6, wherein inside of the storing part is provided with a chamber having a space whose volume is changed according to movement of the pumping part so as to generate pressure for discharging fluid.

8. The apparatus for manufacturing cosmetic using instantaneous emulsification of claim 1, wherein the operative unit includes a sliding surface which slides along an inner surface of the housing so as to move along the inner surface of the housing by external force.

9. The apparatus for manufacturing cosmetic using instantaneous emulsification of claim 1, wherein the operative unit includes pressing surfaces which are capable of pressing the pumping parts of the internal phase container and the external phase container at the same time.

10. The apparatus for manufacturing cosmetic using instantaneous emulsification of claim 1, wherein the operative unit includes a plurality of flow paths which are capable of transferring to the channel unit the internal phase fluid discharged from the internal phase container, and the external phase fluid discharged from the external phase container.

11. The apparatus for manufacturing cosmetic using instantaneous emulsification of claim 1, wherein the respective mixing parts include:

a first rotation path for guiding an entering fluid to be rotated in one direction;

a second turning path which guides the fluid rotating in one direction to be rotated in another direction; and a direction converting path which changes a rotational direction of fluid between the first turning path and the second turning path.

12. The apparatus for manufacturing cosmetic using instantaneous emulsification of claim 1, wherein the plurality of mixing parts which are formed on the channel unit are provided three or more in number.

13. The apparatus for manufacturing cosmetic using instantaneous emulsification of claim 1, wherein the internal phase container and the external phase container include a cartridge which is separably and replaceably coupled to the housing.

* * * * *